US007198344B2

(12) United States Patent
Eguchi et al.

(10) Patent No.: US 7,198,344 B2
(45) Date of Patent: Apr. 3, 2007

(54) LIQUID EJECTING DEVICE AND LIQUID EJECTING METHOD

(75) Inventors: Takeo Eguchi, Kanagawa (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/142,855

(22) Filed: Jun. 1, 2005

(65) Prior Publication Data

US 2005/0206669 A1 Sep. 22, 2005

Related U.S. Application Data

(63) Continuation of application No. 10/452,366, filed on Jun. 2, 2003, now Pat. No. 6,916,077.

(30) Foreign Application Priority Data

Jun. 3, 2002 (JP) ..... 2002-161928
Feb. 14, 2003 (JP) ..... 2003-037343

(51) Int. Cl.
*B41J 29/38* (2006.01)

(52) U.S. Cl. ..... 347/12; 347/77; 347/48

(58) Field of Classification Search ..... 347/41, 347/15, 43, 16, 77, 12, 48
See application file for complete search history.

(56) References Cited

U.S. PATENT DOCUMENTS 4,575,730 A * 3/1986 Logan et al. ..... 347/9
5,172,139 A 12/1992 Sekiya et al.
5,841,452 A 11/1998 Silverbrook
5,940,996 A 8/1999 Cummings
6,074,046 A 6/2000 Wen
6,164,748 A 12/2000 Taneya et al.
6,478,414 B2 11/2002 Jeanmaire
6,749,286 B2 6/2004 Eguchi
6,916,077 B2 * 7/2005 Eguchi et al. ..... 347/12
2003/0058289 A1 3/2003 Yamada et al.

FOREIGN PATENT DOCUMENTS

| | | |
|---|---|---|
| EP | 0 895 864 | 2/1999 |
| EP | 1 201 435 | 5/2002 |
| JP | 06-210856 | 8/1994 |
| JP | 2000-185403 | 7/2000 |
| JP | 2003-211666 | 7/2003 |
| WO | PCT/JP00/09423 | 12/2000 |
| WO | WO 01/47713 | 7/2001 |

* cited by examiner

*Primary Examiner*—Lamson Nguyen
(74) *Attorney, Agent, or Firm*—Robert J. Depke; Rockey, Depke, Lyons & Kitzinger LLC

(57) ABSTRACT

A liquid ejecting device can print a high quality image having an increased number of gradations without having a complex head structure, and is suitable for use in a line head. The liquid ejecting device includes a head in which liquid ejecting portions including nozzles are arranged in parallel. A droplet can be deflected at the moment of ejection from the nozzle of each of liquid ejecting portion. By controlling at least two different liquid ejecting portions in adjacent positions to eject droplets, a pixel column or a pixel is formed.

24 Claims, 18 Drawing Sheets

FIG. 6

| METHOD | RELATED ART | | METHOD 1 | | METHOD 2 | | | |
|---|---|---|---|---|---|---|---|---|
| PIXEL NUMBER | N | N + 1 | N | N + 1 | N | N + 1 | N + 2 | N + 3 |
| POSITION IN WHICH INK DROPLET IS DELIVERED | NOT SELECTED | | SELECTABLE BETWEEN TWO POSITIONS | | SELECTABLE FROM FOUR POSITIONS | | | |
| NUMBER OF PIXELS = 2 | | | | | | | | |
| NUMBER OF PIXELS = 3 | | | | | | | | |
| NUMBER OF PIXELS = 4 | | | | | | | | |
| NUMBER OF PIXELS = 5 | | | | | | | | |

FIG. 8A
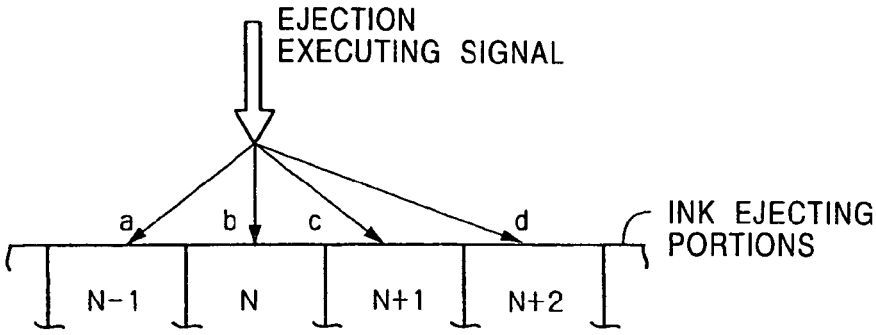
FIG. 8B
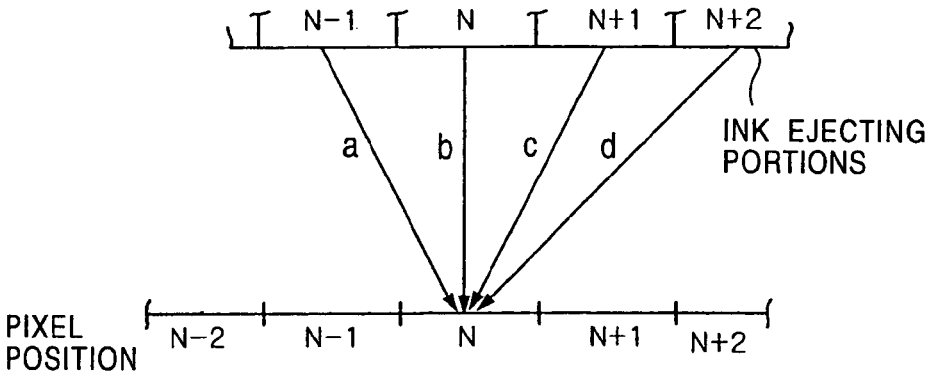
FIG. 8C
| B1 | B2 | DEFLECTION POSITION | SW |
|---|---|---|---|
| 1 | 1 | a | a |
| 0 | 1 | b | b |
| 1 | 0 | c | c |
| 0 | 0 | d | d |

LIQUID EJECTING DEVICE AND LIQUID EJECTING METHOD

The subject matter of U.S. application Ser. No. 10/452,366 is incorporated herein by reference. The present application is a continuation of U.S. application Ser. No. 10/452,366, filed Jun. 2, 2003, which claims priority to Japanese Patent Application No. JP2002-161928, filed Jun. 3, 2002, and Japanese Patent Application No. JP2003-037343, filed Feb. 14, 2003. The present application claims priority to these previously filed applications.

BACKGROUND OF THE INVENTION

1. Field of the Invention

The present invention relates to a liquid ejecting device including a head in which a plurality of liquid ejecting portions each having nozzles are arranged in parallel, and a liquid ejecting method using a head in which a plurality of liquid ejecting portions having nozzles are arranged in parallel. The present invention also relates to a technology that forms a pixel column or a pixel by deflecting droplets ejected from the nozzle of each liquid ejecting portion, and using a plurality of different liquid ejecting portions in adjacent positions.

2. Description of the Related Art

A method that uses an area ratio gray-scale method to represent an image has been known as a typical half-toning method in printing technology. In the area ratio gray-scale method, an image is decomposed into pixels of the minimized size and is represented by points of colors. A halftone gradation method and a dithering pattern gradation method are known as types of the area ratio gray-scale method. In the former, the diameters of dots having constant thickness are changed, while in the latter, dot density in a unit area is changed, with the dot diameter maintained to be constant.

Inkjet printers also use a method similar to the above area ratio gray-scale method. The method is divided into the following three types depending on the head structure of each inkjet printer.

FIG. 18 illustrates a method by superimposition, which is a first example of the related art. In FIG. 18, a head forms dots onto printing paper by ejecting droplets while moving in the arrow direction (the direction from left to right). At first, in the first movement (indicated by the dotted line in FIG. 18) of the head, the head forms dots a1 and a2 by ejecting droplets so that regions in which the dots a1 and s2 are formed can overlap with each other. In the second movement (indicated by the solid line in FIG. 18) of the head, the head forms dots a3 and a4 by ejecting droplets so that the dots a3 and a4 can respectively overlap with the dots a1 and a2 formed in the first movement and so that the dots a3 and a4, which are adjacent in the head moving direction, can overlap with each other.

As described above, one pixel composed of the four dots a1, a2, a3, and a4 is formed. This formation of one pixel from the four dots a1 to a4 can express five gradations, including the case of no dot. Also, by increasing the precision of the dot-formed positions in the first and second movements, a high quality image can be obtained.

FIG. 19 illustrates a method by droplet amount, which is a second example of the related art. In the second example, a head can switch the amount of droplets for ejection to three levels. The head forms a pixel by using any of a small dot b1, an intermediate dot b2, and a large dot b3. It is said that this method can increase printing speed.

FIG. 20 illustrates a method by the number of dots, which is a third example of the related art. In this method, dots c1, c2, . . . , whose diameters are smaller than a dot pitch are consecutively ejected. In addition, before a first formed dot is absorbed by (infiltrates) printing paper, the next dot is formed so as to, at least, overlap with the first delivered dot. In the example in FIG. 20, after the dot cl is first formed, dots c2, c3, and c4 are sequentially formed before the dot c1 is absorbed by (infiltrates) the printing paper. This forms a larger dot c5 (in this case, dot c5 corresponds to one pixel).

The above examples of the related art have the following problems.

In the first example, the dots a1 to a4 must be formed in one pixel formation region a plural number of times (four times in the first example). Thus, a photograph or the like which has many gradations requires a longer printing time, compared with the case of printing a document. Also, although some number of gradations can be obtained, there is a limitation in increasing the number of gradations.

In the second example, it is difficult to accurately control the quantities of ejected droplets. This causes variations in the quantities of ejected droplets, and it is difficult to obtain stable image quality. Also, in order that plural types of droplet quantities may be ejected, the head structure becomes complicated, thus causing a high cost. Moreover, if droplet quantity can be changed, the number of types is limited to about three.

In addition, when the head has an ink ejecting portion that does not eject droplets, or an ink ejecting portion that ejects droplets of insufficient quantities, image quality deteriorates. Accordingly, printing using superimposition as in the first example must also be used. This causes a problem of a long printing time.

In the third example, after droplets are ejected once, a time is required to fill the ink ejecting portions with ink for the ejected ink. Thus, a certain amount of time is needed until re-ejection of droplets. Specifically, for example, a certain amount of time is required from ejection of the droplet for forming the dot c1 to ejection of the droplet for forming the dot c2.

As a result, during a movement of the head in one line in a serial method, in one pixel formation region, it is difficult to form the dots c2, c3, and c4 by delivering droplets before the formed dot c1 is absorbed by (infiltrates) the printing paper. Also, the movement speed of the head is very small when the head is moved so that, after the ink ejecting portions are filled with ink, in one pixel formation region, the dots c2, c3, and c4 can be formed before the formed dot c1 is absorbed by (infiltrates) the printing paper. Accordingly, this case is not practical.

As described in the first example and the third example, a method that forms one dot a5 so that the dots a1 to a4 overlap with one another, and a method that forms one dot c5 so that the dots c1 to c4 overlap with one another are characteristic in a serial method in which the head ejects ink droplets while moving back and forth in a line direction (the direction perpendicular to the traveling direction of the printing paper). Accordingly, in the case of a line head whose head portion cannot move in the line direction since nozzles are arranged in parallel in a width direction, a method such as the first example or the third example cannot substantially be employed. This is because, since the line head does not move in the line direction, the first and third examples cannot cope with a situation in which some nozzles have a defect such as no ejection of droplets.

SUMMARY OF THE INVENTION

It is an object of the present invention to perform printing of a high definition image having an increased number of gradations without complicating a head structure and to provide a structure adapted for a line head.

According to an aspect of the present invention, a liquid ejecting device having at least one head including a plurality of liquid ejecting portions each having a nozzle is provided. The liquid ejecting device includes an ejection deflector for ejecting a droplet with deflection from the nozzle of each of the plurality of liquid ejecting portions in a plurality of directions, and an ejection controller for controlling ejection so that, by ejecting droplets in different directions from at least two different liquid ejecting portions in adjacent positions among the plurality of liquid ejecting portions while using the ejection deflector, the droplets are delivered in a single column to form a pixel column, or the droplets are delivered in a single pixel region to form a pixel.

According to the present invention, by ejecting droplets in different directions from at least two different liquid ejecting portions in adjacent positions, a pixel column or a pixel is formed. For example, by ejecting droplets from adjacent liquid ejecting portions N and (N+1), the droplets can be delivered in a single pixel region or a single pixel-region column.

Therefore, a pixel or a pixel column can be formed by using different liquid ejecting portions.

According to another aspect of the present invention, a liquid ejecting device having at least one head including a plurality of liquid ejecting portions each having a nozzle is provided. The liquid ejecting device includes an ejection deflector for ejecting a droplet with deflection from the nozzle of each of the plurality of liquid ejecting portions so that the droplets are delivered to positions to which droplets ejected from the nozzle of either adjacent liquid ejecting portion are delivered without being deflected, or the vicinity thereof, and an ejection controller in which, when a pixel column or a pixel is formed by delivering droplets so that at least two regions to which the droplets are delivered can overlap with each other, by using at least two different liquid ejecting portions in adjacent positions among the plurality of liquid ejecting portions and by using the ejection deflector to eject droplets with deflection from at least one of the two different liquid ejecting portions, the pixel column or the pixel can be formed.

According to the present invention, from the nozzle of each of liquid ejecting portions, at least one droplet can be ejected without being deflected, and the droplets can be delivered so that the droplets are delivered to positions to which droplets ejected from the nozzle of another adjacent liquid ejecting portion are delivered without being deflected, or the vicinity thereof. For example, in a case in which droplets are ejected from adjacent liquid ejecting portions N and (N+1), when positions to which droplets ejected from the liquid ejecting portions N and (N+1) are delivered without being deflected are respectively represented by positions N and (N+1), the liquid ejecting portion N can eject and deliver the droplet to the position N without deflecting the droplet, and can eject and deliver the droplet to the position (N+1) by deflecting the droplet. Similarly, the liquid ejecting portion (N+1) can eject and deliver the droplet to the position (N+1) without deflecting the droplet, and can eject and deliver the droplet to the position N by deflecting the droplet.

When a pixel column is formed by delivering droplets in column, or a pixel is formed by delivering droplets so that at least two regions to which the droplets are delivered overlap with each other, ejection is controlled so that, by using at least two different liquid ejecting portions in adjacent positions and by deflecting droplets ejected from at least one of the liquid ejecting portions, the pixel column or the pixel is formed. For example, after a droplet is ejected and delivered from the liquid ejecting portion N to the position N without being deflected, a droplet is ejected and delivered from the liquid ejecting portion (N+1) to the position N, with it deflected.

Therefore, by using different liquid ejecting portions, a pixel column or a pixel can be formed.

According to another aspect of the present invention, a liquid ejecting method using at least one head including a plurality of liquid ejecting portions each having a nozzle is provided. Droplets are ejected from the nozzle of each of the plurality of liquid ejecting portions with deflection in a plurality of directions, and by ejecting droplets in different directions from at least two different liquid ejecting portions in adjacent positions among the plurality of liquid ejecting portions, the droplets are delivered in a single column to form a pixel column, or the droplets are delivered in a single pixel region to form a pixel.

According to another aspect of the present invention, a liquid ejecting method using at least one head including a plurality of liquid ejecting portions each having a nozzle is provided. At least one droplet is ejected from the nozzle of each of the plurality of liquid ejecting portions with deflection so that the droplet is delivered to a position to which a droplet ejected from the nozzle of another adjacent liquid ejecting portion without being deflected is delivered, or the vicinity thereof, and when a pixel column is formed or when a pixel is formed by delivering droplets so that at least two regions in which the droplets are delivered can overlap with each other, by using at least two different liquid ejecting portions in adjacent positions among the plurality of liquid ejecting portions, and by deflecting droplets ejected from at least one of the two different liquid ejecting portions, the pixel column or the pixel is formed.

BRIEF DESCRIPTION OF THE DRAWINGS

FIG. 6 is a table illustrating two methods (Method 1 and Method 2) for an ejection controller in the present invention and the related method;

FIGS. 8A, 8B, and 8C are illustrations of a "preset format" for controlling the ejection selector and a "format conforming to the preset format for the ejection selector" for controlling the ejection determiner;

DESCRIPTION OF THE PREFERRED EMBODIMENTS

First Embodiment

A first embodiment of the present invention is described below with reference to the accompanying drawings.

In this Specification, an "ink droplet" is a minute quantity (e.g., several picoliters) of ink (liquid) ejected from a nozzle 18 (described later). A "dot" is a spot formed such that one ink droplet is delivered onto printing paper or the like. A "pixel" is the smallest unit of an image. A "pixel region" is a region in which a dot is formed.

By delivering a predetermined number of (zero, one, or plural) droplets to a pixel region, a pixel (with one gradation) having no dot, a pixel (with two gradations) composed of one dot, or a pixel (with three or more gradations) composed of plural dots is formed. In other words, one pixel region corresponds to one, or zero or plural dots. An image is formed by arranging, on a recording medium, a great number of pixels as described.

Each dot corresponding to a pixel may protrude from the pixel region without completely falling in the pixel region.

Head Structure

Figure 1:
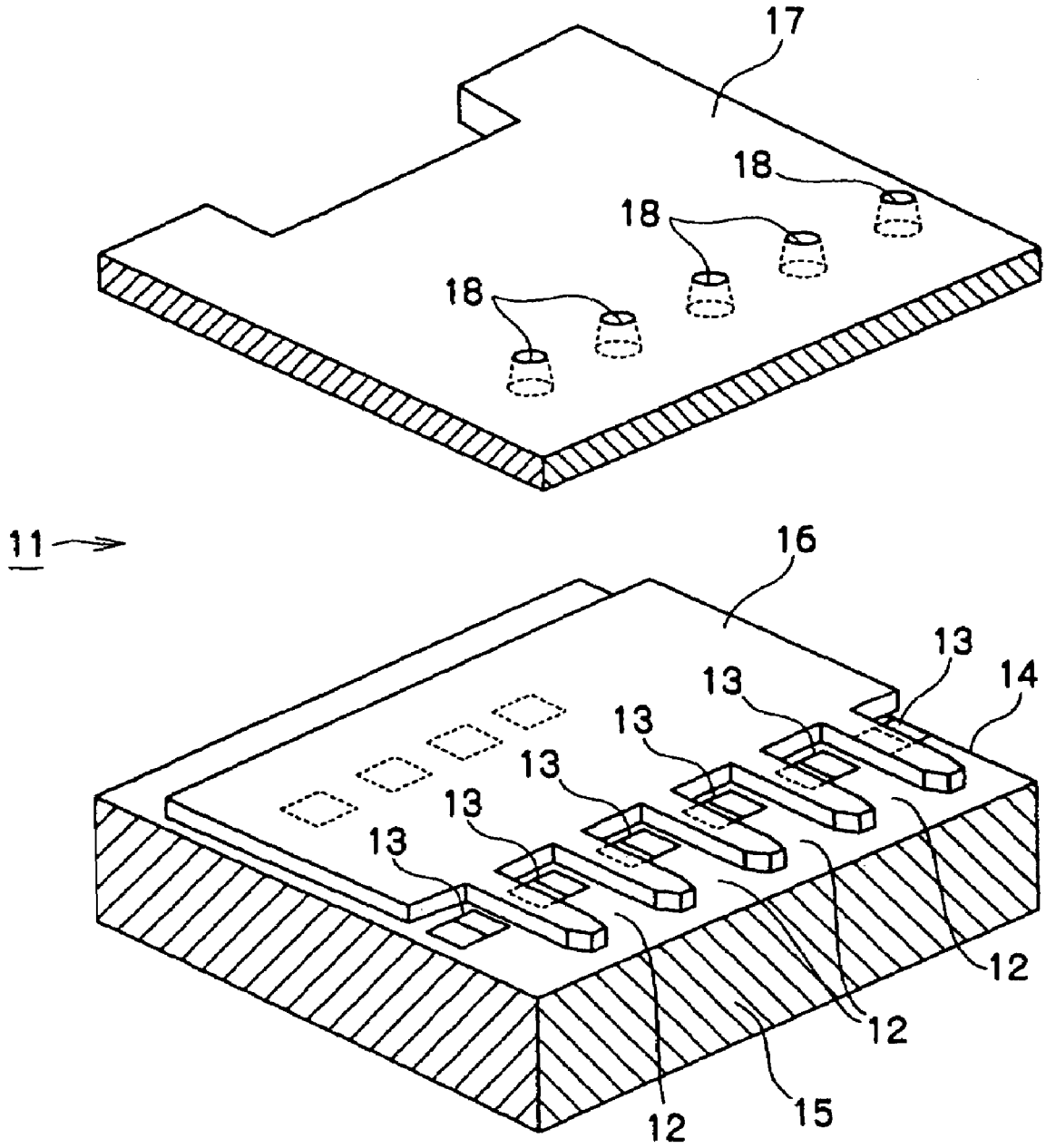
FIG. 1 is an exploded perspective view showing a head of an inkjet printer to which a liquid ejecting device of the present invention is applied.

FIG. 1 is an exploded perspective view showing a head 11 of an inkjet printer (hereinafter referred to simply as a "printer") to which a liquid ejecting device of the present invention is applied. In FIG. 1, a nozzle sheet 17 is bonded to a barrier layer 16, and the nozzle sheet 17 is shown in an exploded form.

In the head 11, a substrate member 14 includes a semiconductor substrate 15 composed of silicon or the like, and heating resistors 13 (corresponding to energy generating elements or heating elements in the present invention) formed on one surface of the semiconductor substrate 15. The heating resistors 13 are electrically connected to an external circuit by a conductor portion (not shown) formed on the semiconductor substrate 15.

The barrier layer 16 is formed by, for example, an exposure-hardening dry film resist, and is formed by stacking the resist on the entirety of the surface of the semiconductor substrate 15 on which the heating resistors 13 are formed, and subsequently removing unnecessary portions in a photolithography process.

The nozzle sheet 17 has a plurality of nozzles 18 therein, and is formed by, for example, electroforming technology using nickel. The nozzle sheet 17 is bonded onto the barrier layer 16 so that the positions of the nozzles 18 can correspond to the positions of the heating resistors 13, that is, the nozzles 18 can oppose the heating resistors 13.

Ink cells 12 are constituted so as to surround the heating resistors 13 by the substrate member 14, the barrier layer 16, and the nozzle sheet 17. Specifically, the substrate member 14 forms the bottom walls of the ink cells 12, the barrier layer 16 forms the side walls of the ink cells 12, and the nozzle sheet 17 forms the top walls of the ink cells 12. In this structure, the ink cells 12 have aperture regions in the front right of FIG. 1. The aperture regions are connected to ink-flow paths (not shown).

The above head 11 normally includes the ink cells 12 in units of hundreds, and the heating resistors 13, which are disposed in the ink cells 12. In response to a command from the control unit of the printer, each heating resistor 13 is uniquely selected, and the ink of the ink cell 12 corresponding to the heating resistor 13 can be ejected from the nozzle 18 opposing the ink cell 12.

In other words, the ink cell 12 is filled with ink supplied from an ink container (not shown) joined to the head 11. By allowing a pulse current to flow through the heating resistor 13 in a short time, for example, 1 to 3 microseconds, the heating resistor 13 is rapidly heated. As a result, a gas-phase ink bubble is produced in a portion in contact with the heating resistor 13, and the expansion of the ink bubble dislodges ink of some volume (the ink boils). In this manner, ink of a volume equal to that of the dislodged ink in the portion touching the nozzle 18 is ejected as an ink droplet from the nozzle 18, and is delivered onto the printing paper, thus forming a dot.

In this Specification, a portion constituted by one ink cell 12, the heating resistor 13 disposed in the ink cell 12, and the nozzle 18 disposed thereon is referred to also as an "ink ejecting portion (liquid ejecting portion)". Specifically, the head 11 has a plurality of ink ejecting portions arranged in parallel.

Ejection Deflector

The head 11 includes an ejection deflector. In this embodiment, the ejection deflector deflects an ink droplet ejected from one nozzle 18 so that the ink droplet can be delivered to a position to which an ink droplet from another adjacent nozzle 18 can be delivered without being deflected, or the vicinity thereof. The head 11 has the following structure.

Figure 2A:
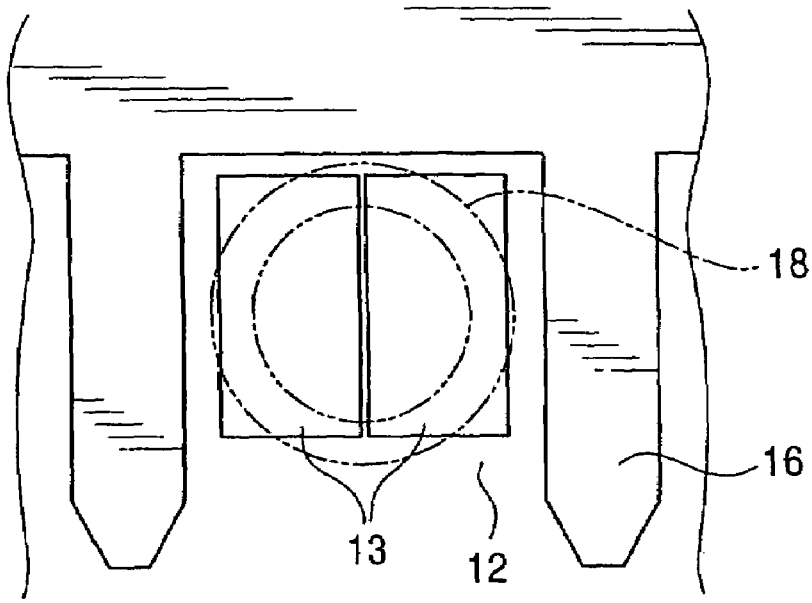
FIG. 2 consists of a detailed plan view and side sectional view showing the arrangement of heating resistors.
Figure 2B:
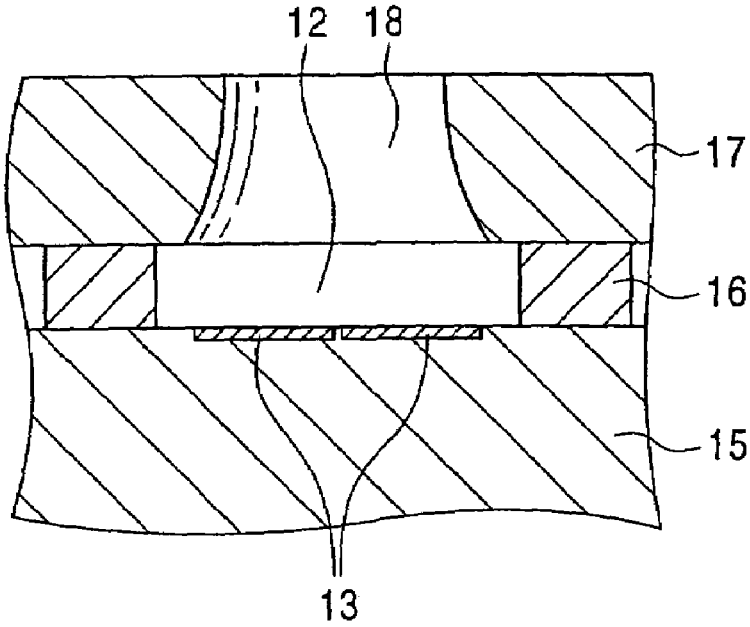

FIG. 2 consists of a detailed plan view and side sectional view showing the arrangement of the heating resistors 13 in the head 11. In the plan view in FIG. 2, the position of the nozzle 18 is indicated by the chain lines.

As shown in FIG. 2, in the head 11 in this embodiment, one ink cell 12 includes bisected heating resistors 13 arranged in parallel. The direction in which the heating resistors 13 are arranged is a direction (the horizontal direction in FIG. 2) in which the nozzles 18 are arranged.

In such a bisected type in which one heating resistor 13 has longitudinally bisected portions, each separated heating resistor 13 has the same length and a half width. Thus, the resistance of the bisected heating resistors 13 is double that of the original heating resistor 13. By connecting the bisected heating resistors 13 in series, the separated heating resistors 13 having the double resistances are connected in series, so that the total resistance is four times that of the original heating resistor 13.

Here, in order that the ink in the ink cell 12 may boil, the heating resistor 13 must be heated by supplying a certain amount of power to it. This is because energy generated at the boil is used to eject the ink. When the resistance is small, a current to flow must be increased. However, by increasing the resistance of the heating resistor 13, the ink can be brought to a boil with a small current.

This can also reduce the size of a transistor or the like for passing the current, thus achieving a reduction in occupied space. By reducing the thickness of the heating resistor 13, the resistance can be increased. However, when considering material selected for the heating resistor 13 and its strength (durability), there is a limitation in reducing the thickness of the heating resistor 13. Accordingly, by separating the heating resistor 13 without reducing its thickness, its resistance is increased.

When one ink cell 12 includes the bisected heating resistors 13, if the time (bubble producing time) required for each heating resistor 13 to reach a temperature for boiling the ink is set to be equal, the inks boil on two heating resistors 13 and an ink droplet is ejected in the central axis direction of the nozzle 18.

Conversely, when there is a difference between the bubble producing times of the bisected heating resistors 13, portions of the ink do not boil on the bisected heating resistors 13 at the same time. This shifts the direction of the ink droplet from the central axis direction of the nozzle 18, and the ink droplet is ejected and deflected. This delivers the ink droplet off a position to which the ejected ink droplet can be delivered without being deflected.

Figure 3B:
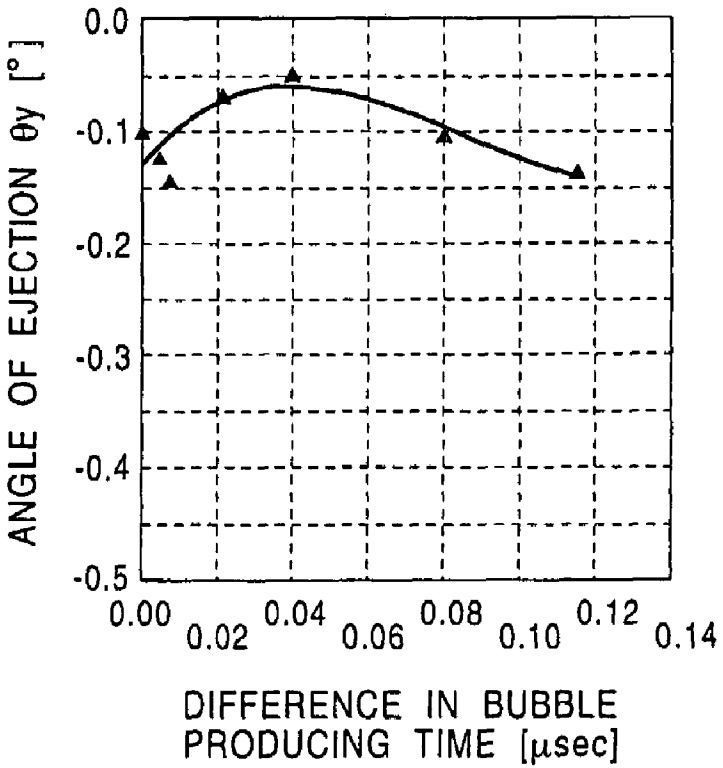
FIG. 3 consists of graphs showing the relationship obtained in the case of each separate heating resistor 13 as in this embodiment between a difference in bubble producing time of ink and the ejection angle of ink droplets.
Figure 3A:
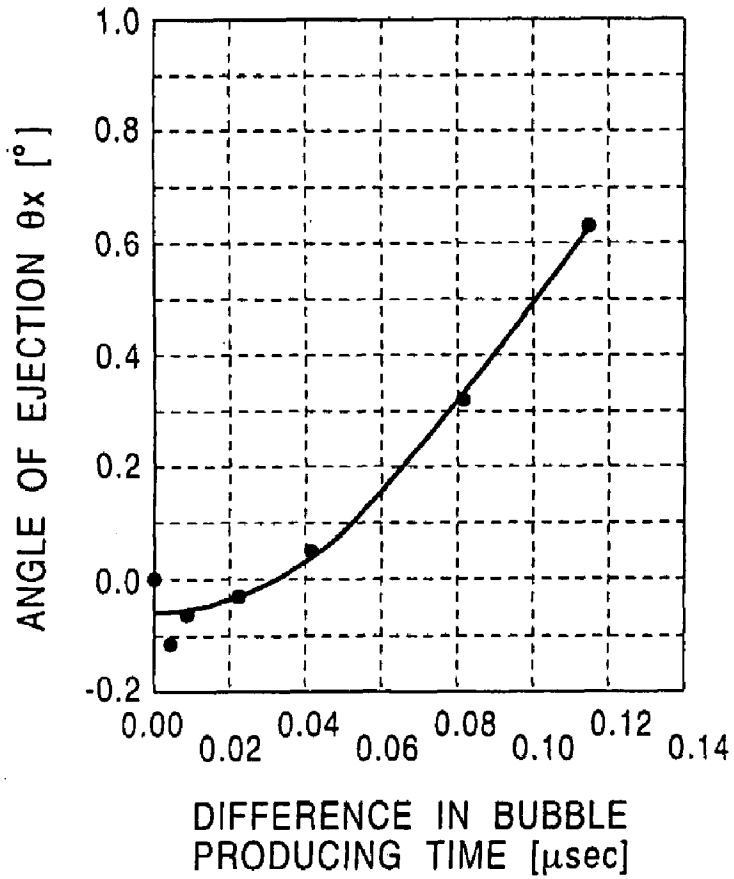

FIGS. 3A and 3B are graphs showing the relationship obtained in the case of each separate heating resistor 13 in this embodiment between a difference in bubble producing time of ink and the ejection angle of ink droplet. The values shown in the graphs are computer-simulated results. In FIG. 3A, the X-direction (the direction indicated by vertical axis θx of the graph) (note that the X-direction does not mean the horizontal axis of the graph) indicates a direction (the direction of the heating resistors 13 arranged in parallel) in which the nozzles 18 are arranged. The Y-direction (the direction indicated by vertical axis θy of FIG. 3B) (note that the Y-direction does not mean the vertical axis of the graph) indicates a direction perpendicular to the X-direction, which is a direction in which the printing paper is carried. In both the X-direction and the Y-direction, an angle at which no deflection occurs is represented by zero degrees, and a shift from the zero degrees is indicated.

Figure 3C:
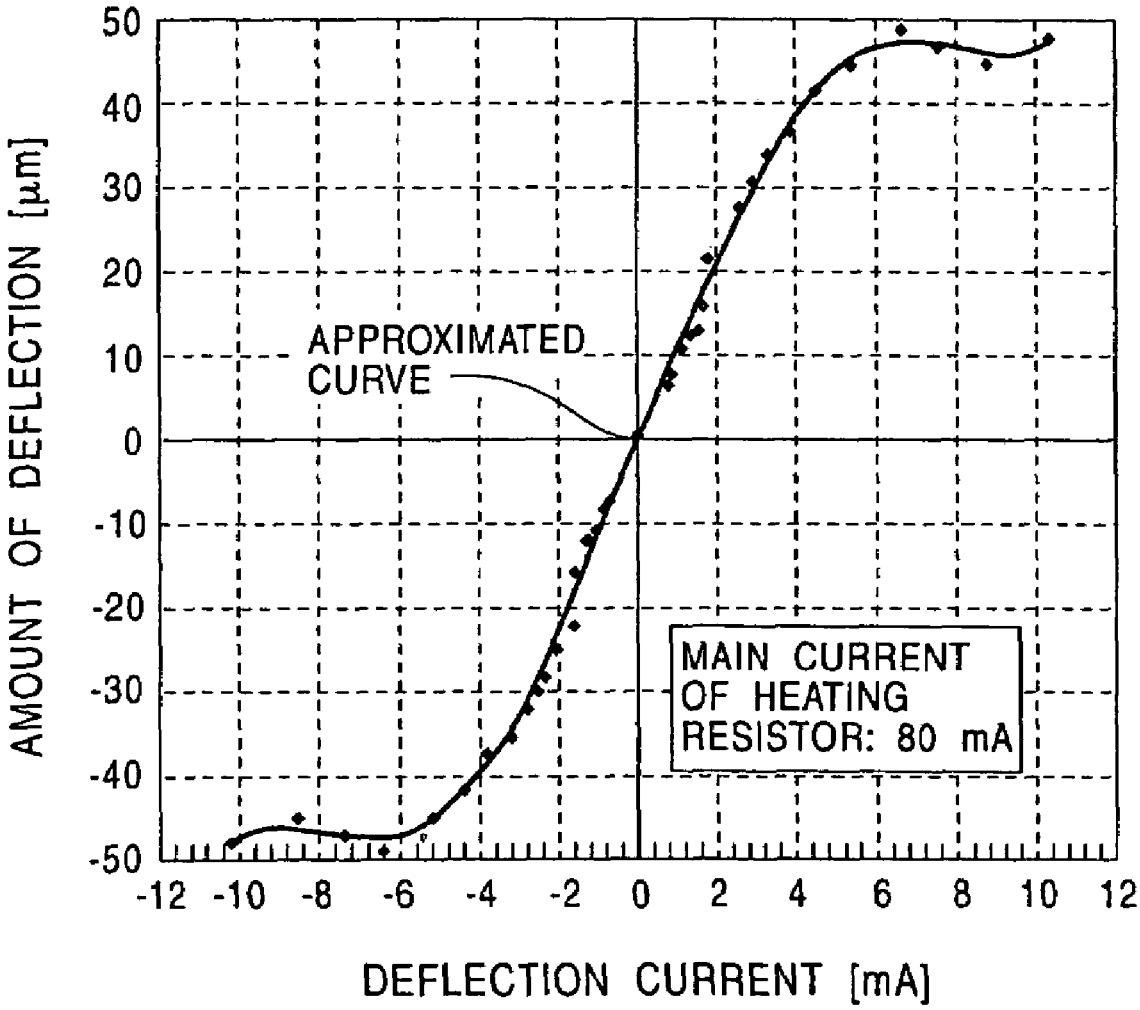

FIG. 3C is a graph showing actually measured data. A deflection current (We use a half of a difference current between the bisected heating resistors 13 in FIG. 3C) is indicated as difference in bubble producing time between the bisected heating resistors 13 by the horizontal axis, and an amount of deflection (actually measured when the distance between the nozzle and a position to which ink is delivered was set at approximately 2 mm) in the position to which ink is delivered is indicated as the angle (X-direction) of ejection of ink by the vertical axis. FIG. 3C also shows a case in which, with the main current of the heating resistors 13 set to 80 mA, the deflection current was superimposed on one of the heating resistors 13 and the ink was ejected and deflected.

When there is a time difference in production of bubbles by the heating resistors 13 bisected in the direction in which nozzles 18 are arranged, the angle of ejection of ink is not perpendicular, and the angle θx of ejection of ink in the direction in which the nozzles 18 are arranged increases in proportion to the difference in bubble producing time.

Accordingly, in this embodiment, by using this feature, that is, by providing the bisected heating resistors 13, and supplying different currents to the bisected heating resistors 13, a difference is set in bubble producing time of the heating resistors 13, whereby the direction in which ink is ejected is changed.

When the resistances of the bisected heating resistors 13 are not equal to each other due to, for example, a production error or the like, the heating resistors 13 have a difference in bubble producing time. Thus, the angle of ejection of ink is not perpendicular, so that the position to which the ink is delivered is off from the correct position. However, by supplying different currents to the heating resistors 13 for controlling the bubble producing time of each heating resistor 13 to be equal, the angle of ejection of ink can be set at perpendicularity.

Accordingly, in this embodiment, by using this feature an angle at which an ink droplet is ejected can be changed by setting the bisected heating resistors 13 to have a difference in bubble producing time.

Figure 4:
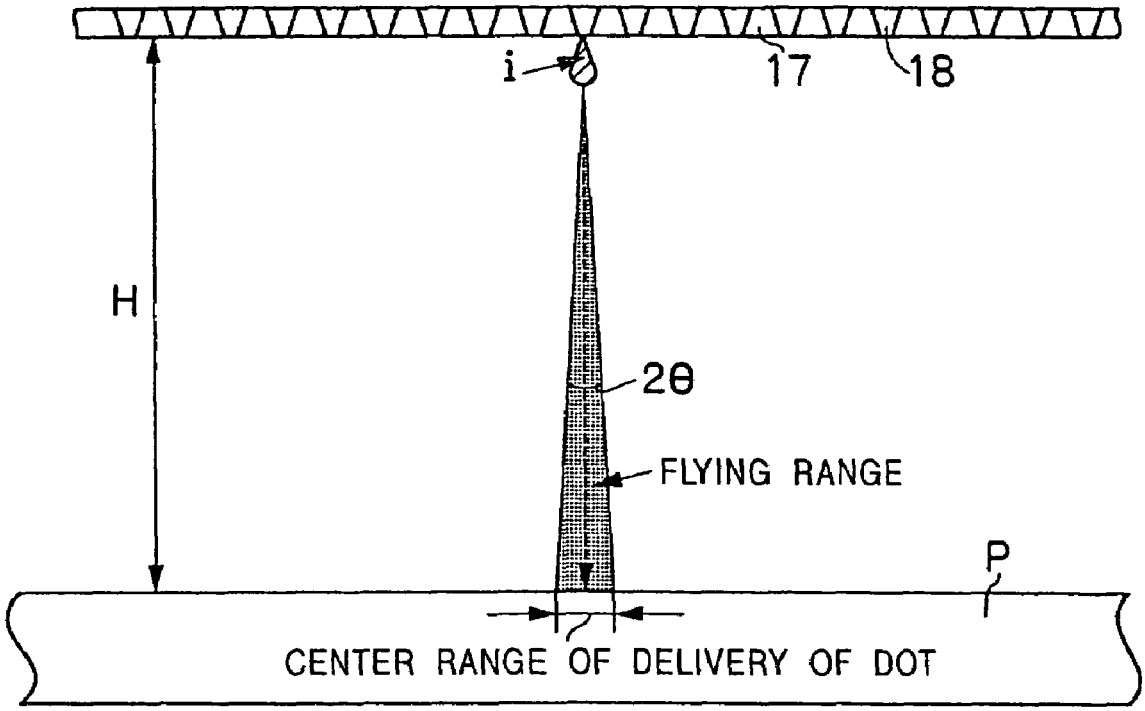
FIG. 4 is a side sectional view showing the relationship between nozzles and printing paper.

Next, how much the angle of the ejected ink droplet is changed is described below with reference to FIG. 4. FIG. 4 is a side sectional view showing the relationship between the nozzles 18 and printing paper P.

In FIG. 4, although the distance H between the tips of the nozzles 18 and the printing paper P is approximately 1 to 2 mm in the case of an ordinary inkjet printer, it is here-assumed that H=2 mm.

That the distance H must be maintained to be almost constant is because a change in the distance H causes a change in the position to which each ink droplet is delivered. In other words, when one nozzle 18 ejects an ink droplet perpendicularly to the surface of the printing paper P, the position to which the ink droplet is delivered does not change, even if the distance H is slightly changed. Conversely, in the case of performing deflected ejection of an ink droplet, as described above, the position to which the ink droplet is delivered differs in accordance with a change in the distance H.

When the resolution of the head 11 is set to 600 DPI, the interval between adjacent nozzles 18 is $$25.40\times1000/600\approx42.3\ (\mu m)$$

Here, in the present invention, the direction in which ink droplets are ejected from the nozzles 18 is changed to $2^J$ different directions by using a control signal represented by J bits (where J represents a positive integer), and the distance between farthest positions of two delivered ink droplets among the $2^J$ directions is set so as to be $(2^J-1)$ times the interval between two adjacent nozzles 18. When ink droplets are ejected from the nozzles 18, any one direction is selected from the $2^J$ directions.

For example, when a signal in which J=2 (bits) is used as the control signal, the number of types of the control signal is four, that is, (0, 0) , (0, 1) , (1, 0), and (1, 1). Thus, the direction of an ejected ink droplet is $2^J=4$. Also, the distance between two farthest dots when deflection occurs is $((2^J-1)=)$ 3 times the interval between two adjacent nozzles 18.

Whenever the control signal changes to (0, 0), (0, 1), (1, 0), and (1, 1), the position of a delivered ink droplet can be moved by the interval between adjacent nozzles 18.

In the above example, assuming that the triple of the interval (42.3 μm) between adjacent nozzles 18, that is, 126.9 μm is the distance between two farthest dots when deflection occurs, a maximum deflection angle 2θ (deg) is $$\tan 2\theta = 126.9/2000 \approx 0.0635$$

Thus, $$2\theta \approx 3.6(\text{deg})$$

Next, the method that deflects the ejected ink droplet is more specifically described below.

Figure 5:
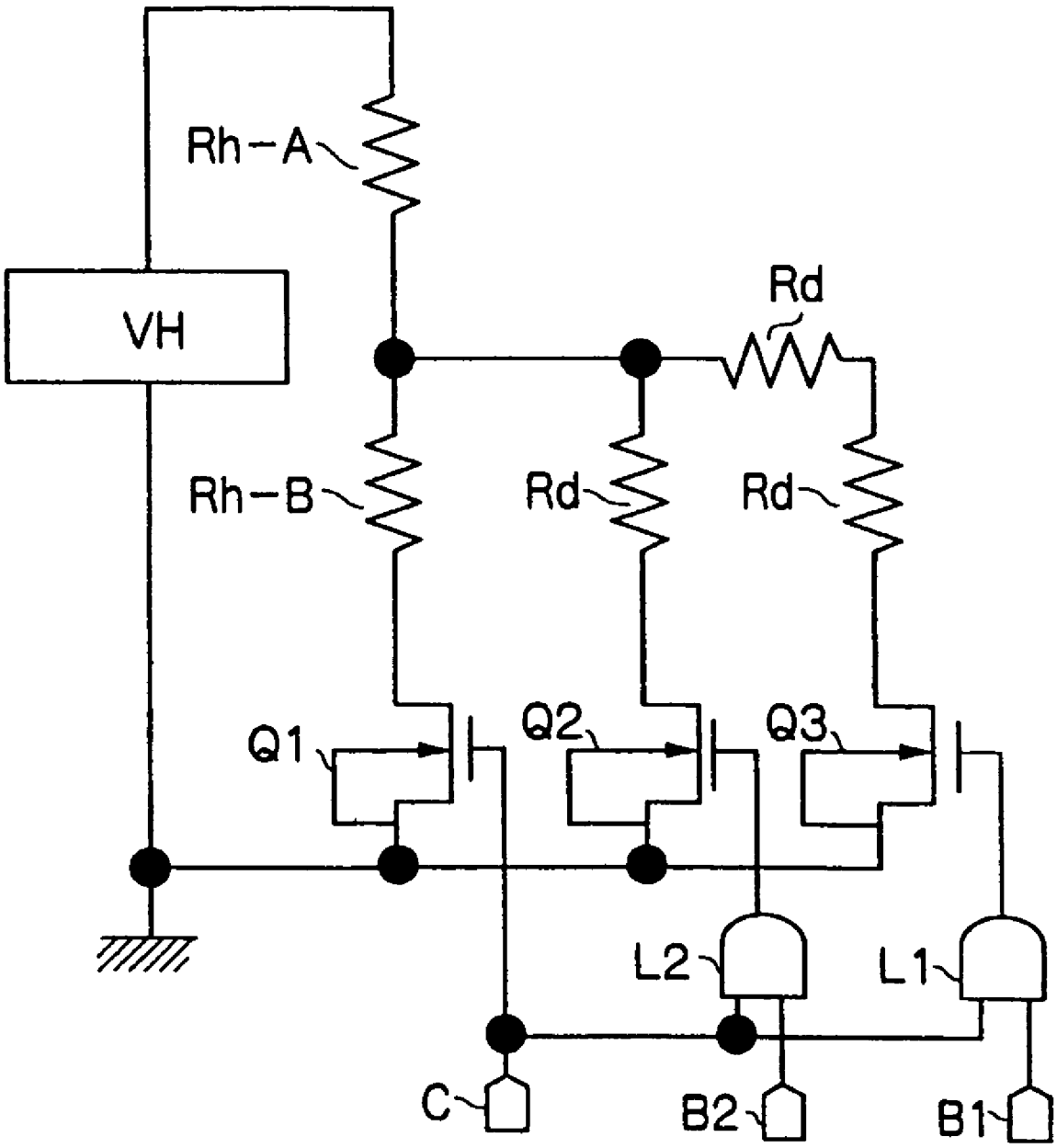
FIG. 5 is a conceptual circuit diagram showing a circuit in which the difference in bubble producing time of bisected heating resistors can be set.

FIG. 5 is a schematic circuit diagram showing a circuit in which the difference in bubble producing time of the bisected heating resistors 13 can be set. In this example, by using a control signal in which J=2 (bits) so that the difference in current flowing in resistors Rh-A and Rh-B can be set to four types, the ejected ink droplet can be set to have four directions for ejection.

In FIG. 5, the resistors Rh-A and Rh-B correspond to the resistances of the bisected heating resistors 13, respectively. In this embodiment, the resistance of the resistor Rh-A is set to be less than that of the resistor Rh-B. The resistors Rh-A and Rh-B have a junction (intermediate point) therebetween from which a deflection current can flow. Three resistors Rd are used to deflect an ejected ink droplet. Also, transistors Q1, Q2, and Q3 function as switches for the resistors Rh-A, Rh-B, and Rds.

The circuit in FIG. 5 includes an input portion C for a binary control input signal (whose state is "1" only when a current flows). It includes binary-input AND gates L1 and L2, and input portions B1 and B2 for binary signals ("0" or "1") for the AND gates L1 and L2.

In this case, when the input portion is supplied with "1", and both input portions B1 and B2 are supplied with "0"s, only the transistor Q1 operates and the transistors Q2 and Q3 do not operate (no currents flow in the three resistors Rd). At this time, when current flows in the resistors Rh-A and Rh-B, the currents flowing in the resistors Rh-A and Rh-B have equal values. Because the resistance of the resistor Rh-A is less than that of the resistor Rh-B, the heat value of the resistor Rh-A is less than that of the resistor Rh-B. In this condition, the ejected ink droplet is delivered to the most left in this embodiment (FIG. 5). In addition, the position to which the ejected ink droplet is delivered is set to be a position (including its vicinity) to which an ink droplet ejected from a nozzle 18 (ink ejecting portion) left from a reference position with one nozzle 18 therebetween is delivered without being deflected (FIG. 8B).

In this case, when the input portion C is supplied with "1", and the input portions B1 and B2 are supplied with inputs "1" and "0", a current flows also in two resistors Rd connected in series to the transistor Q3 (no current flows in the resistor Rd connected to the transistor Q2). As a result, a current that flows in the resistor Rh-B is less than that obtained when the input portions B1 and B2 are supplied with "0"s. However, also in this case, the resistor Rh-A is set to have a heat value less than that of the resistor Rh-B.

In this case, the position to which ejected ink droplets are delivered is set to be a position to which ink droplets ejected from the adjacent left nozzle 18 are delivered without being deflected.

Next, when the input portion C is supplied with "1", and the input portions B1 and B2 are supplied with "0" and "1", a current flows in the resistor Rd connected to the transistor Q2 (no currents flow in the two resistors Rd connected in series to the transistor Q3). As a result, the value of the current that flows in the resistor Rh-B is further less than that obtained when the input portions B1 and B2 are supplied with "1" and "0". In this case, the resistors Rh-A and Rh-B can be set to have identical heat values. This ejects the ink droplets without deflection.

When the input portion C is supplied with "1", and both input portions B1 and B2 are supplied with "1" and "0", currents flow in the three transistors Rd connected to the transistors Q2 and Q3. As a result, the value of the current that flows in the resistor Rh-B is further less than that obtained when the input portions B1 and B2 are supplied with "0" and "1". In this case, the resistor Rh-A is set to have a heat value more than that of the resistor Rh-B.

In this case, the position to which ejected ink droplets are delivered is set to be a position to which ink droplets ejected from the adjacent right nozzle 18 as an ink ejecting portion are delivered without being deflected.

As described above, given the resistances Rh-A, Rh-B by heating condition, Rd may be set so that, whenever the inputs to the input portions B1 and B2 change to (0, 0), (1,0), (0, 1), and (1, 1), the position to which the ejected ink droplets are delivered can move at each interval between the nozzles 18.

This can change the position to which the ejected ink droplet is delivered to four positions, that is, in addition to the position to which the ink droplets ejected (perpendicularly to the surface of an object, such as printing paper, onto which an ink droplet is delivered) from the nozzle 18 without being deflected can be delivered, a position (including its vicinity) to which an ink droplet ejected from the nozzle 18 (ink ejecting portion) left from a reference position with one nozzle 18 therebetween is delivered without being deflected, a position to which an ink droplet ejected from the adjacent left nozzle 18 can be delivered without being deflected, and a position to which an ink droplet ejected from the adjacent right nozzle 18 as an ink ejecting portion can be delivered without being deflected (FIG. 8B). In response to the input values to the input portions B1 and B2, the ink droplet can be delivered to an arbitrary position among the above four positions (FIG. 8B).

Ejection Controller

The embodiment described thus far also includes an ejection controller. The ejection controller controls the formation of ink droplets (dots) in such a manner that, by using the ejection deflector, when ink droplets are delivered in line (almost in the same row) to form a dot column, or ink droplets are delivered to form one dot in a form in which at least some regions of delivered droplets overlap with each other, at least two different ink ejecting portions adjacently positioned are used and ink droplets ejected from at least one of the ink ejecting portions are deflected by the ejection deflector to form a pixel column or pixel.

FIG. 6 is a table illustrating two methods (Method 1 and Method 2) for the ejection controller in the present invention and a method of the related method. FIG. 6 also shows the case of forming one pixel by arranging ink droplets in column so that at least some regions of delivered droplets overlap with each other.

At first, Method 2 is an example in which the position to which ink droplets ejected from each ink ejecting portion are delivered can be selected from among four positions, as described above. In other words, by using J=2 (bits) to control the position to which ink droplets are delivered, each ink ejecting portion can deliver the ink droplets to any one of ($2^J$=) 4 positions of delivery. In Methods 1 and 2 in FIG. 6, the arrangements of dots are not shown straight. This shows that the dots are ejected from a plurality of ink ejecting portions.

In FIG. 6, pixel numbers in the direction of ink ejecting portions (the nozzles 18) are indicated by N, (N+1) (N+2), and (N+3). Also, ink ejecting portions from which ejected ink droplets are delivered to pixel numbers N, (N+1), (N+2), and (N+3) without being deflected are referred to as N, (N+1), (N+2), and (N+3), respectively (Ejecting portions are not indicated in FIG. 6).

When the number of gradations is 2, ink droplets are ejected from the ink ejecting portions N, (N+1), (N+2), and (N+3) without being deflected, and are delivered to pixel numbers N, (N+1), (N+2) , and (N+3) to form dots corresponding to pixels. A case in which no ink droplets are ejected corresponds to a case in which the number of gradations is 1.

When the number of gradations is 3, in addition to the ink droplets ejected when the number of gradations is 2, to pixel number N, an ink droplet is ejected and delivered from the ink ejecting portion (N−1) which is positioned at left of N in FIG. 6 ((N−1) is not indicated in FIG. 6, Ejecting portion which is positioned at left of (N−1) is (N−2), . . . , and so on), with it deflected. To pixel number (N+1), an ink droplet is ejected and delivered from the ink ejecting portion N, with it deflected. To pixel number (N+2), an ink droplet is ejected and delivered from the ink ejecting portion (N+1), with it deflected. To pixel number (N+3), an ink droplet is ejected and delivered from the ink ejecting portion (N+2), with it deflected.

In other words, when the number of gradations is 3, in each pixel, a dot having a diameter larger than that obtained when the number of gradations is 2 is formed.

When the number of gradations is 4, in addition to the ink droplets when the number of gradations is 3, to pixel number N, an ink droplet is ejected from the ink ejecting portion (N−2), with it deflected, and is delivered. To pixel number (N+1), an ink droplet is ejected from the ink ejecting portion (N−1), with it deflected, and is delivered. To pixel number (N+2), an ink droplet is ejected from the ink ejecting portion N, with it deflected, and is delivered. To pixel number (N+3), an ink droplet is ejected from the ink ejecting portion (N+1), with it deflected, and is delivered.

In other words, when the number of gradations is 4, an area in the pixel region which is occupied by the dots is larger than that obtained when the number of gradations is 3.

When the number of gradation is 5, in addition to the ink droplets delivered when the number of gradations is 4, ink droplets ejected from the ink ejecting portion (N−3) are deflected and delivered to pixel number N. To pixel number (N+1), ink droplets ejected from the ink ejecting portion (N−2) are deflected and delivered. To pixel number (N+2), ink droplets ejected from the ink ejecting portion (N−1) are deflected and delivered. To pixel number (N+3), ink droplets ejected from the ink ejecting portion N are deflected and delivered.

In other words, when the number of gradations is 5, an area occupied by dots in the pixel region is larger than that obtained when the number of gradations is 4.

By using the above technique, in any of cases in which the number of gradations is 3, 4, and 5, ink droplets ejected consecutively from a single ink ejecting portion are prevented from being delivered in the pixel region of a single pixel number. Thus, if the quantity of ink droplets from any ink ejecting portion is insufficient, a difference in the areas occupied by dots can be reduced.

Method 1 shows a 1-bit example. In other words, by using J=1 (bit) to control the position to which ink ejecting portions are delivered, each ink ejecting portion can deliver the ink droplets to ($2^J$=) 2 positions of delivered droplet. In this case, each ink ejecting portion can eject ink droplets without deflection, and can deliver the ink droplets to a position to which an ejected ink droplet can be delivered from an adjacent ink ejecting portion. In this embodiment, an ink droplet is ejected from the ink ejecting portion N without being deflected, and can be delivered to a position to which an ink droplet is ejected and delivered from the ink ejecting portion (N+1) without being deflected.

Similarly to the above, pixel numbers in a direction in which the ink ejecting portions (the nozzles 18, Ejecting portions are not indicated in FIG. 6) are arranged are indicated by N and N+1. Also, ink ejecting portions that deliver ink droplets to pixel numbers N and (N+1) when ejecting the ink droplets without deflection are referred to as N and (N+1), respectively.

When the number of gradations is 2, ink droplets are ejected from the ink ejecting portions N and (N+1) without being deflected, and are delivered to pixel numbers N and N+1 to form a pixel (dot) corresponding to the gradation number 2.

When the number of gradations is 3 in addition to the ink droplets delivered when the number of gradations is 2, to the pixel number N, ink droplets ejected from the ink ejecting portion (N−1) are deflected and is delivered. Also, to the pixel number (N+1), ink droplets are ejected from the ink ejecting portion N and are delivered.

When the number of gradations is 4 in addition to the ink droplets delivered when the number of gradations is 3, to the pixel number N, ink droplets are ejected from the ink ejecting portion N without being deflected, and is delivered. To the pixel number (N+1), ink droplets are ejected from the ink ejecting portion (N+1) without being deflected, and is delivered.

Moreover, when the number of gradations is 5 in addition to the ink droplets delivered when the number of gradations is 4, to the pixel number N, ink droplets ejected from the ink ejecting portion (N−1) are deflected and delivered. To the pixel number (N+1), ink droplets ejected from the ink ejecting portion N is deflected and is delivered.

By using the above technique, for the number of gradations required, in the pixel corresponding to one pixel number, a dot can be formed such that the same ink ejecting portion does not deliver ink droplets consecutively (sequentially two times). Thus, a change in the dot for each ink ejecting portion can be reduced. Also, even if the quantity of an ink droplet from any of the ink ejecting portions is insufficient, a variation in the areas occupied by dots of pixels can be reduced.

Conversely, in the related art, in any one of pixel numbers N and N+1, if the number of gradations increases, ink droplets ejected from the same ink ejecting portion are always delivered (each pixel is formed by dots from a single ink ejecting portion). Accordingly, when the quantity of an ink droplet from any of the ink ejecting portions is insufficient, a change in droplet quantity increases whenever the number of gradations increases.

Next, an image forming method regarding a pixel position in image printing and ink-droplet-ejection executing timing is described below.

Figure 7:
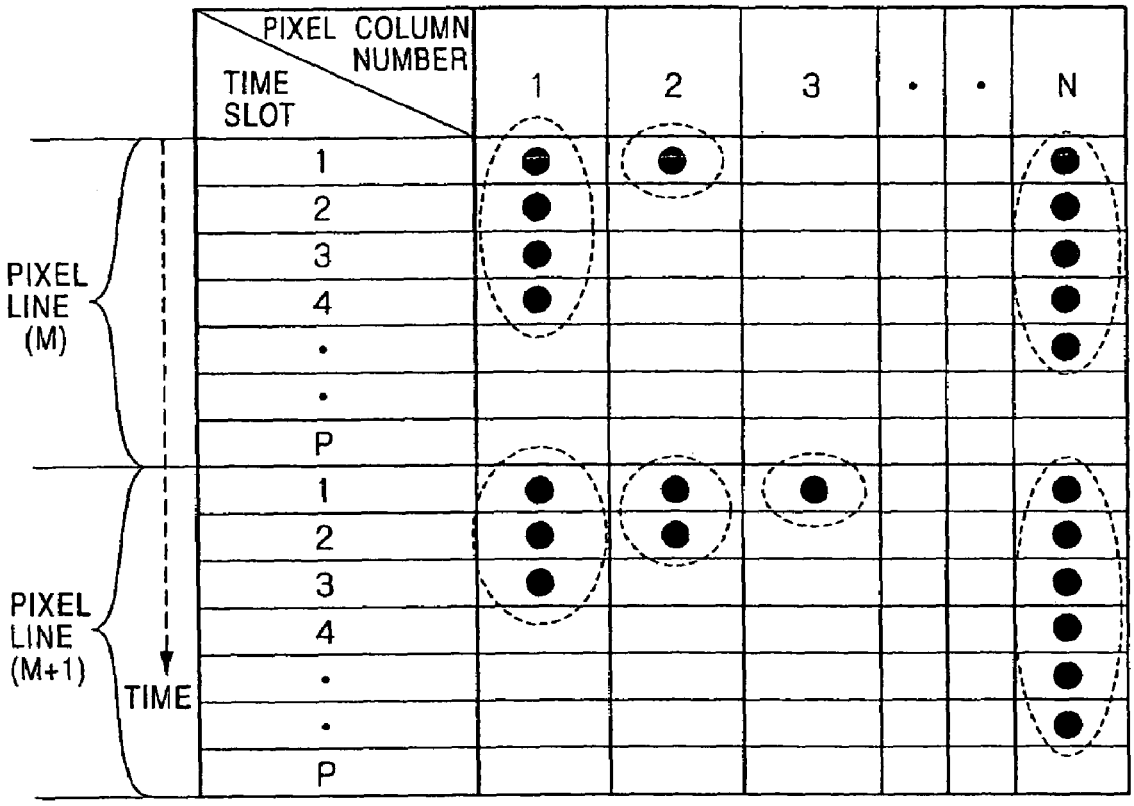
FIG. 7 is an illustration of the number of times (the time required for dot formation in each pixel position) which is required to form dots in pixel positions.

In FIG. 7, the vertical direction represents an arbitrary time domain, and the horizontal direction represents an arbitrary distance. The arbitrary time domain corresponds to timing with which the ejection of ink droplets in accordance with the number of gradations is executed, and the arbitrary distance corresponds to a pixel position corresponding to the direction of arranged nozzles 18. In other words, FIG. 7 shows the number of times (i.e., the time required for dot formation in each pixel) an ink droplet is ejected which is required for forming a dot in each pixel position. In FIG. 7, lines (which are formed during a first (the same) scanning term) in the direction of arranged nozzles 18 for the pixels are defined as pixel lines. Among the pixel lines, an M line and an (M+1) line are vertically shown. For each pixel, a maximum of, for example, P ink droplets can be ejected. Thus, each pixel has ink-droplet-ejection timing 1 to ink-droplet-ejection timing P, and these are indicated by time slots. In other words, in each pixel, a dot is formed by a maximum of P ink droplets (i.e., the maximum number of gradations is P+1 including no droplet). The first to N-th pixel positions are horizontally indicated in FIG. 7. Accordingly, the number of the nozzles 18 in the arrangement direction is also N.

In FIG. 7, to pixel number 1 in the M-th line, an ink droplet is ejected four times and the four ink droplets form a dot for the pixel number 1. To the pixel number 1 in the (M+1)-th line, an ink droplet is ejected three times, whereby three regions occupied by the dots are formed in the pixel region corresponding to the pixel number 1 in the (M+1) line.

Here, the pixel number 1 in the M-th line and the pixel number 1 in the (M+1)-th line are delivered almost in the same (pixel) column. Pixels in other pixel numbers are also in a similar situation.

As described above, a pixel formed at pixel (column) number 1, and the M-th pixel line by one or more ink droplets, and a pixel formed at the pixel column number 1 and the (M+1)-line by one or more ink droplets are delivered almost in the same column, in this embodiment. In this case, one of ink ejecting portions for ejecting the first ink droplet to form the pixel in the M-th line, and one of the ink ejecting portions for ejecting the first ink droplet to form the pixel in the (M+1)-th line can be controlled to differ from each other.

By using this technique, for example, in the case of forming a pixel by one ink droplet, dots formed by the same ink ejecting portion are not delivered in consecutive positions in the same column. Similarly, in the case of forming a pixel by using a few (odd) number of ink droplets, the same ink ejecting portion which is first used to form the dots should be used alternately with others which can deliver dots to the same pixel column.

Accordingly, for example, when a pixel is formed, and the ink droplet cannot be ejected due to clogging or the like in the ink ejecting portion, the use of the same ink ejecting portion continuously makes it impossible to form dots in that particular pixel column. However, by using the above technique, such a situation can be avoided.

In addition, ink ejecting portions may randomly be selected other than the above technique. One of an ink ejecting portion for forming the dot in the M-th line and an ink ejecting portion for ejecting the first ink droplet for forming the dot in the M-th line, and one of an ink ejecting portion for forming the dot in the (M+1)-line and an ink ejecting portion for ejecting the first ink droplet for forming the dot in the (M+1)-th line may be controlled so as not to be always the same.

Ink-ejecting-portion Selector and Ejection-direction (Deflection) Controller

In this embodiment, the ejection controller includes an ink-ejecting-portion selector and an ejection-direction controller.

Based on a preset format (manner or pattern), the ink-ejecting-portion selector selects one or more ink ejecting portions for ejecting ink droplets from among a plurality of ink ejecting portions.

The ejection-direction controller determines an ink-droplet ejecting direction based on a format conforming to the above format set for ink-ejecting-portion selection by the ink-ejecting-portion selector.

The "preset format" for controlling the ink-ejecting-portion selector and the "format conforming to the format set for ink-ejecting-portion selection by the ink-ejecting-portion selector" for controlling the ejection-direction controller are described below with reference to FIGS. 8A, 8B, and 8C. FIG. 8A illustrates how an image signal as an ejection executing signal is sent to ink ejecting portions. For example, as shown in FIG. 8A, an ejection executing signal for forming a dot for pixel N is supplied to ink ejecting portion N (an ink ejecting portion that ejects an ink droplet to pixel N when the ejection is not deflected) and ink ejecting portions (N−1), (N+1), and (N+2) which are adjacent to ink ejecting portion N in the cycle of a, b, c, and d. In the cycle of a, b, c, and d, a dot for one pixel is formed. In the example in FIG. 8A, the ejection executing signal corresponds to an image signal in which the maximum number of gradations is 5.

Of course, this invention can form a different maximum number of gradations. For example, 2 cycles of a, b, c, d can form a maximum number of gradations 9. 1.5 cycles can form a maximum number of gradations 7. 0.5 cycles can form a maximum number of gradations 3, etc.

The above is the concept of the "preset format" for controlling the ink-ejecting-portion selector.

Next, the "format conforming to the format set for ink-ejecting-portion selection by the ink-ejecting-portion selector" for controlling the ejection-direction controller is described below.

As shown in FIG. 8B, in accordance with the cycle of a, b, c, and d, the ejection-direction controller deflects the ejection in the cycle of a, b, c, and d. Specifically, an ejection executing signal inputted with timing "a" in the cycle of a, b, c, and d is sent to the ink ejecting portion (N−1) in FIG. 8A, and from the ink ejecting portion (N−1), an ink droplet is ejected and deflected to the direction a targeted to the pixel position N in FIG. 8B. Thus, from the ink ejecting portion (N−1), an ink droplet is ejected and deflected to the region of pixel N. Control of the ink ejection is performed based on the signals B1 and B2. Correspondences between signals B1 and B2 as 2-bit signals, and the cycle of a, b, c, and d are shown in FIG. 8C.

Figure 9:
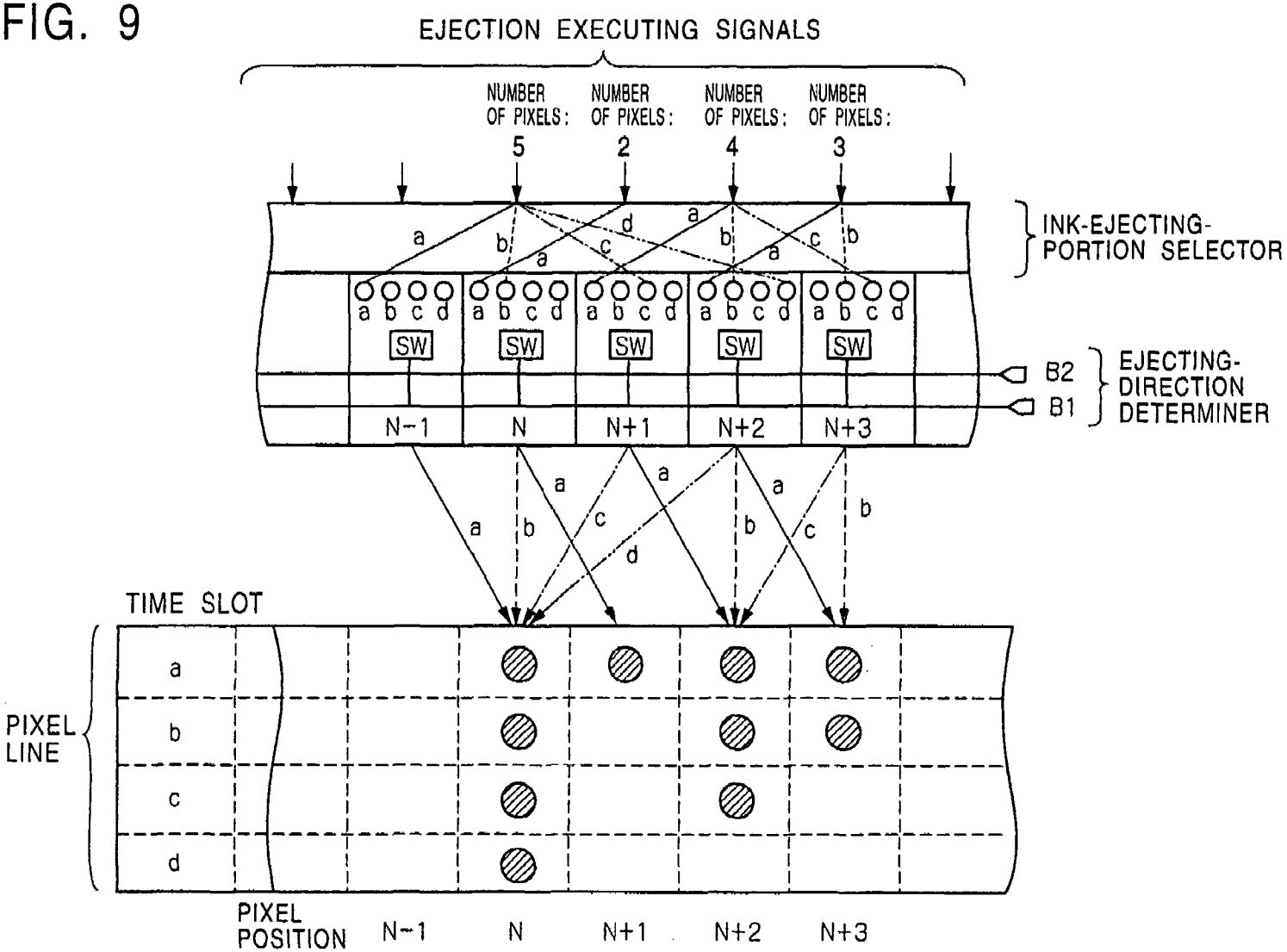
FIG. 9 is an illustration of the formation based on the above format of dots on printing paper.

Next, FIG. 9 is used to describe the formation based on the above format of dots on printing paper. FIG. 9 shows the process of the formation, based on ejection executing signals sent in parallel to the head 11, of dots for pixels on printing paper by ink ejecting portions. The ejection executing signals correspond to the image signals.

In the example in FIG. 9, the number of gradations of the ejection executing signal for the pixel N is set to 5, the number of gradations of the ejection executing signal for the pixel (N+1) is set to 2, the number of gradations of the ejection executing signal for the pixel (N+2) is set to 4, and the number of gradations of the ejection executing signal for the pixel (N+3) is set to 3.

As described above, the ejection signal for each pixel is sent to each predetermined ink ejecting portion in the cycle of a, b, c, and d, and in the same cycle, each ink ejecting portion ejects deflected ink droplets having the cycle of a, b, c, and d. The periods a, b, c, and d correspond to time slots a, b, c, and d, respectively, and one cycle of a, b, c, and d forms one dot for one pixel. For example, in the period a, an ejection executing signal for the pixel N is sent to the ink ejecting portion (N−1), an ejection executing signal for the pixel (N+1) is sent to the ink ejecting portion N, an ejection executing signal for the pixel (N+2) is sent to the ink ejecting portion (N+1), and an ejection executing signal for the pixel (N+3) is sent to the ink ejecting portion (N+2).

From the ink ejecting portion (N−1), the ink droplet is ejected in the a-direction with deflection, and is delivered to the position of the pixel N on the printing paper. Also, from the ink ejecting portion N, the ink droplet is ejected in the a-direction with deflection, and is delivered to the position of the pixel (N+1) on the printing paper. Also, from the ink ejecting portion (N+1), the ink droplet is ejected in the a-direction with deflection, and is delivered to the position of the pixel (N+2) on the printing paper. Also, from the ink ejecting portion (N+2), the ink droplet is ejected in the a-direction with deflection, and is delivered to the position of the pixel (N+3) on the printing paper.

This delivers, to pixel positions on the printing paper, ink droplets corresponding to two gradations. This forms a dot in the pixel (N+1) since the number of gradations is 2 in the ejection executing signal of the pixel (N+1). A similar process is subsequently repeated for the time slots a, b, c, and d.

As a result, in the pixel N, a dot corresponding to the number of gradations being 5 is formed. In the pixel (N+1), a dot corresponding to the number of gradations being 2 is formed. In the pixel (N+2), a dot corresponding to the number of gradations being 4 is formed. In the pixel (N+3), a dot corresponding to the number of gradations being 3 is formed.

Deflection Controller

In this embodiment, the ejection controller includes a deflection controller that determines whether the ejection deflector deflects the ink droplets ejected from the nozzles 18.

In other words, instead of controlling the ink ejecting portions to always eject ink droplets with deflection, based on printing conditions such as an object to be printed and printing speed, it can be determined whether the ejected ink droplets are deflected. For example, by providing a printer operation unit or the like with a deflection controller, a printer user can switch between operation modes depending on a purpose of use.

By way of example, in a case in which, when both a document portion and a photograph (image) portion are printed, black ink is only used to print the document portion without gradation, and in the case of requiring high speed even for printing a photograph, the normal mode is set as the operation mode, and ink droplets are ejected as usual so that positions to which the ink droplets are delivered respectively correspond to ink ejecting portions (i.e., the ink droplets are ejected without being deflected). Conversely, in the photograph mode, as described in this embodiment, a plurality of different ink ejecting portions are used to form one pixel, and at least one ink ejecting portion is controlled to eject and deflect an ink droplet to form a pixel.

The above printing control enables efficient printing.

The present invention can be applied to a serial head which includes a single head 11 and in which the head 11 performs printing while moving in the line direction, and also to a line head in which heads 11 are arranged in parallel in the direction of the ink ejecting portions.

Figure 10:
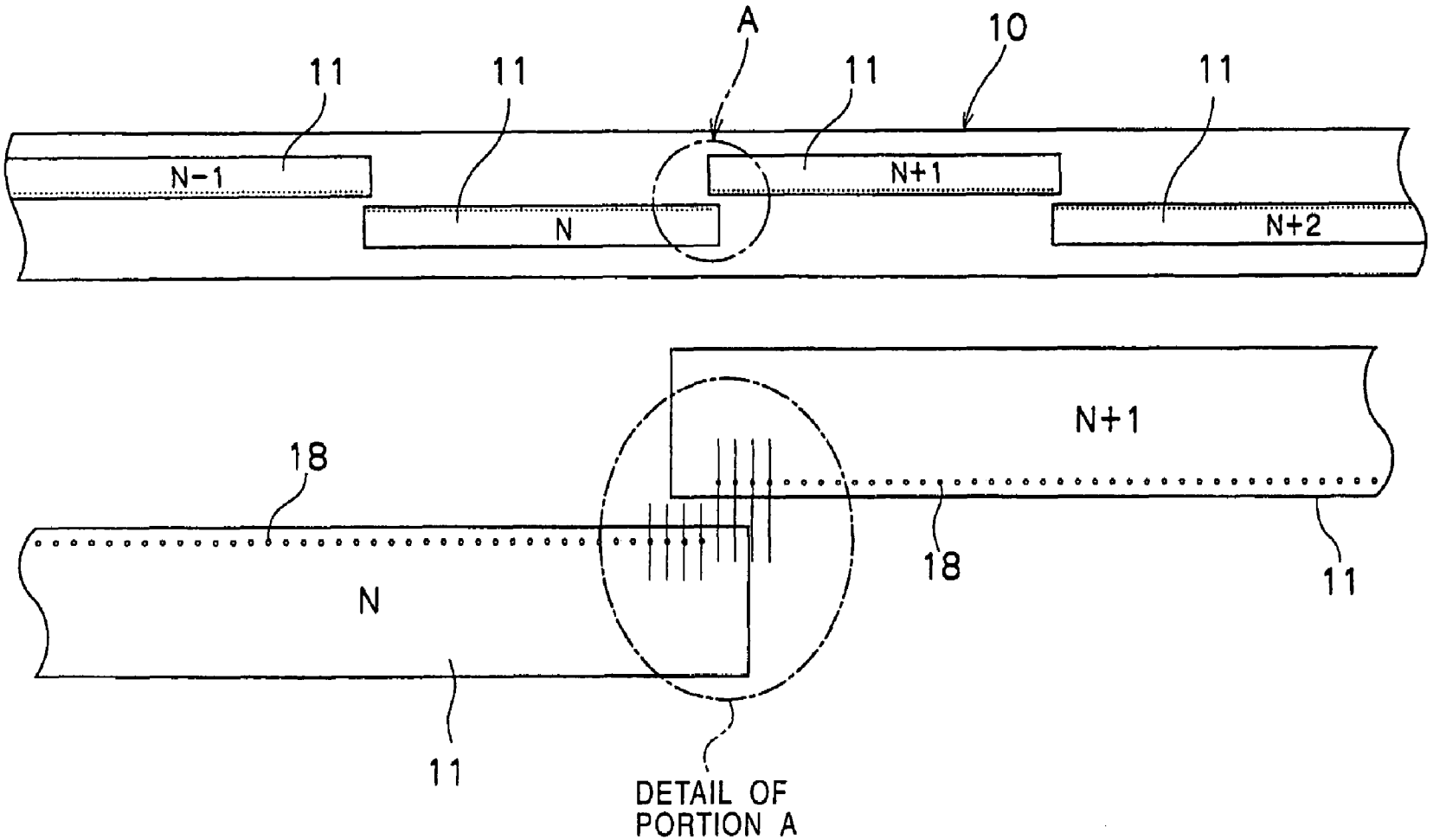
FIG. 10 is an illustration consisting of plan views showing an example of a line head.

FIG. 10 consists of plan views showing an example of a line head 10. FIG. 10 shows four heads 11 (N−1, N, N+1, and N+2). To form the line head 10, a plurality of heads 11 are arranged each of which is formed by the portion (chip) of the head 11 in FIG. 1 excluding the nozzle sheet 17.

By bonding, onto the top of the heads 11, a nozzle sheet 17 in which nozzles 18 are formed in positions corresponding to the ink ejecting portions of the heads 11, the line head 11 is formed.

In the case of the line head 10, each head 11 cannot move in the line direction. Thus, when a dot composed of a plurality of gradations is formed, the related art only forms a dot by ejecting ink from a single ink ejecting portion. However, by applying the present invention, a plurality of adjacent different ink ejecting portions are used to form a dot composed of plural gradations.

Also, in the case of the line head 10, when ink droplets cannot be ejected or there is an ink ejecting portion that ejects insufficient ink, in a pixel column corresponding to the ink ejecting portion, ink droplets are not ejected at all, or the ink droplets are hardly ejected. Thus, no dot is formed to appear as a vertical white stripe, thus deteriorating printed image quality. However, by using the present invention, instead of the ink ejecting portion that cannot eject sufficient ink, other adjacent ink ejecting portions can eject ink droplets. Accordingly, an advantage obtained by applying the present invention to the line head 10 is larger than that of the serial head.

Second Embodiment

Next, a second embodiment of the present invention is described below.

In a second embodiment of the present invention, the ejection deflector in the first embodiment is disclosed as a more specific example, the direction of an ink droplet ejected from the nozzle 18 can be more variously set compared with the first embodiment. In other words, the first embodiment has four directions in which an ink droplet is ejected from the nozzle 18, as shown in FIG. 8. However, the present invention is not limited to the directions of ejection shown in the first embodiment. Accordingly, the second embodiment describes an example in which an ink droplet can be ejected in eight directions (composed of equal numbers of right and left directions) in the direction of the arranged nozzles 18 with respect to the central axes of the nozzles 18 (ink ejecting portions), as described later.

In the following description of the second embodiment, descriptions of portions identical to those of the first embodiment are omitted.

Figure 11:
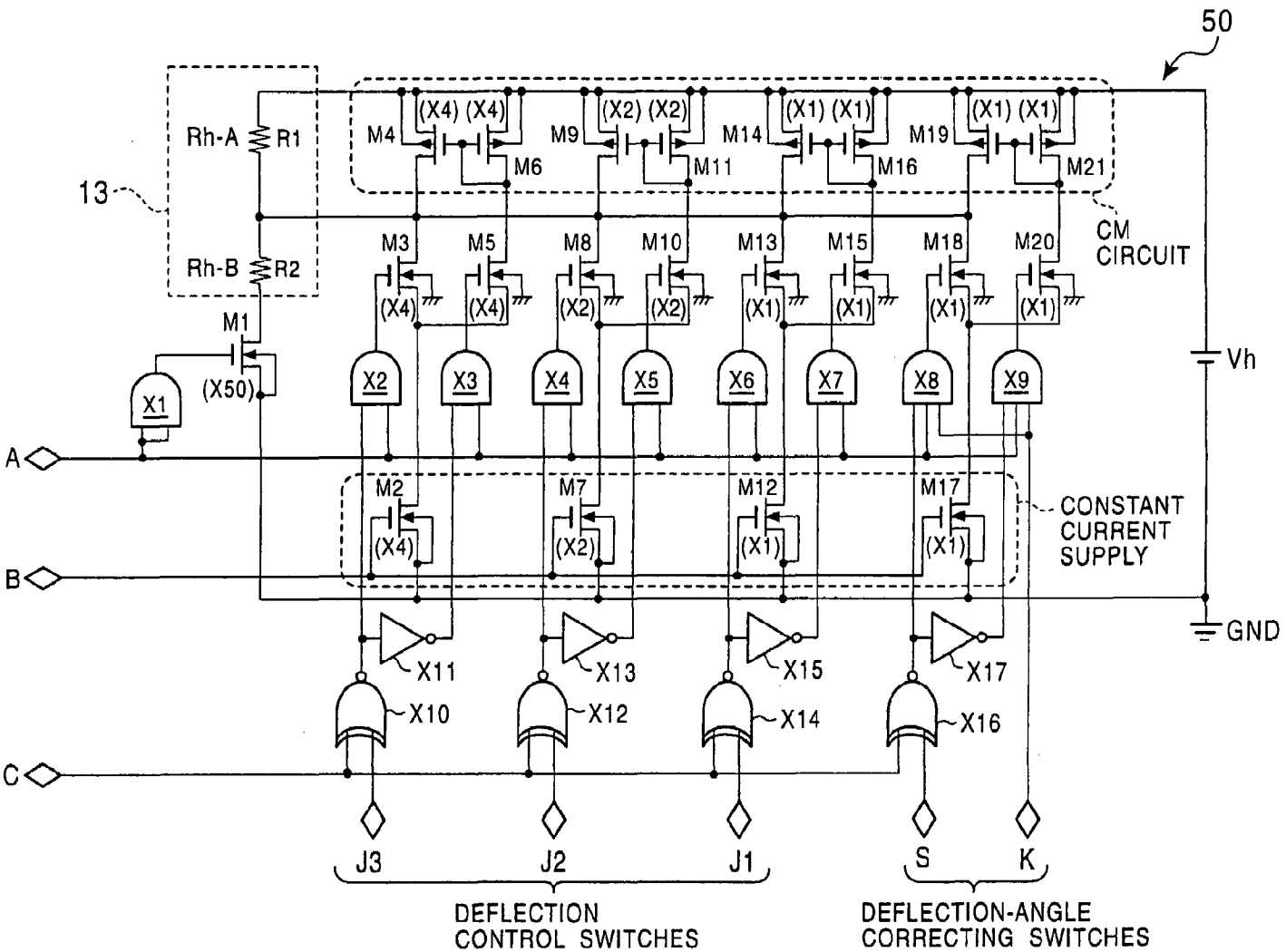
FIG. 11 is a circuit diagram showing an ejection controlling circuit including an ejection deflector in a second embodiment of the present invention.

FIG. 11 shows an ejection-control circuit 50 including an ejection deflector in the second embodiment.

In the second embodiment, bisected resistors 13 (resistors Rh-A and Rh-B in FIG. 11) in the ink cell 12 are connected in series. The resistances of the resistors 13 are set to be almost equal to each other. Thus, by supplying identical amounts of current to the resistors 13 connected to each other in series, an ink droplet can be ejected from the nozzle 18 without being deflected.

A current-mirror circuit (hereinafter referred to as a "CM circuit") is connected to (the midpoint of the) two heating resistors 13 connected to each other in series. By using the CM circuit to allow a current to flow into or to flow out from a junction of the heating resistors 13, a difference is set in the amounts of currents flowing in the heating resistors 13. Based on the difference, ejection is controlled so that an ink droplet ejected from the nozzle 18 can be deflected in the direction of the arranged nozzles 18 (ink ejecting portions).

The use of the above structure in the second embodiment can more flexibly set a direction in which an ink droplet is ejected, compared with the first embodiment.

In FIG. 11, a power supply Vh is used to apply a voltage to the resistors Rh-A and Rh-B.

The ejection-control circuit 50 in FIG. 11 includes transistors M1 through to M21. The transistors M4, M6, M9, M11, M14, M16, M19, and M21 are PMOS transistors, and the other transistors are NMOS transistors. Pairs of the transistors M4 and M6, M9 and M11, M14 and M16, and M19 and M21 constitute CM circuits, respectively. The ejection-control circuit 50 includes four CM circuits.

For example, in the CM circuit composed of the transistors M4 and M6, the gate and drain of the transistor M6 are connected to the gate of the transistor M4. Thus, equal voltages are constantly applied to the transistors M4 and M6, and almost equal currents can flow in them. This similarly applies to the other CM circuits.

The transistors M3 and MS function as a current switch circuit by which a current (generated by M2) is controlled either to flow into the resistors Rh-A and Rh-B through the CM circuit composed of the transistors M4 and M6, or to flow out from the junction of the resistors Rh-A and Rh-B via transistor M3.

Similarly, pairs of the transistors M8 and M10, M13 and M15, and M18 and M20 are respectively second switching elements for the CM circuits formed by the pairs of the transistors M9 and M11, M14 and M16, and M19 and M21.

In the CM composed of the transistors M4 and M6, and the switching element formed by the transistors M3 and M5, the drains of the transistors M4 and M3 are connected to each other, and the drains of the transistors M6 and M5 are connected to each other. This shape also applies to all other switching elements (in this embodiment).

The drains of the transistors M4, M9, M14, and M19 which are parts of the current-mirror circuits, and the drains of the transistors M3, M8, M13, and M18 are connected to the midpoint of the resistors Rh-A and Rh-B.

The drain currents of the transistors M2, M7, M12, and M17 are used as constant current sources for the CM circuits, and their drains are respectively connected to the sources and backgates of the transistors M3, M8, M13, and M18.

The drain of the transistor M1 is connected in series with the resistor Rh-B. It is turned on when an ejection-executing input switch A is in the state "1" (ON), and allows a current to flow in the resistors Rh-A and Rh-B (simultaneously). In other words, the transistor M1 serves as a switch to supply current to the resistors Rh-A and Rh-B.

The output terminals of AND gates X1 through to X9 are connected to the gates of the transistors M1, M3, M5, etc. The AND gates X1 through to X7 are of a two-input type, and the AND gates X8 and X9 are of a three-input type. At least one of the input terminals of the AND gates X1 through to X9 is connected to the ejection-executing input switch A.

XNOR gates X10, X12, X14, and X16 each have an input terminal connected to a deflection-direction switch C, and the other input terminals of the XNOR gates X10, X12, X14, and X16 are connected to deflection-control switches J1 through to J3 and a deflection-angle correcting switch S, respectively.

The deflection-direction switch C is used to switch the direction of ink-droplet ejection in either direction (for the same control signal) in which the nozzles 18 are arranged. When the deflection-direction switch C changes its state ("0" to "1" or "1" to "0"), input logic (provided with nodes J1 through to J3 and S) of the other inputs of the XNOR gate X10, X12, X14, and X16 are inverted.

The deflection-control switches J1 through to J3 are used to determine an amount of deflection for changing the direction of ink-droplet ejection. For example, when the input terminal J3 is in the state "1" (ON), while another input of the same gate connected to the switch C is "1", the output of the XNOR gate X10 is "1".

The output terminal of each of the XNOR gates X10, . . . , X16 is connected to one input terminal of each of the AND gates X2, . . . , X8 and is connected by way of each of NOT gates X11, . . . , X17 to one input terminal of each of the AND gates X3, . . . , X9. One input terminal of each of the AND gates X8 and X9 is connected to an ejection-angle correcting switch K.

A deflection-amplitude control terminal B is used to determine a current for the transistors M2, . . . , M17 used as the constant current supplies for the CM circuits, and is connected to the gate of each of the transistors M2, . . . , M17. Since the application of an appropriate voltage (Vx) to the deflection-amplitude control terminal B supplies a gate-source voltage (Vgs) to all the gates of the transistors M2, . . . , M17, currents flow in each drain of the transistors M2, . . . , M17.

In the above configuration, the parenthesized representation "XN" (N=1, 2, 4, or 50) in each of the transistors M1 to M21 represents a parallel state of element. For example, the representation "X1" (M12, . . . , M21) represents a standard element. The representation "X2" (M7, . . . , M11) represents an element equivalent to one in which two standard elements are connected in parallel. In other words, the representation "XN" represents an element equivalent to one in which N elements are connected in parallel.

The transistors M2, M7, M12, and M17 have the representations "X4", "X2", "X1", and "X1", respectively. Thus, by applying an appropriate voltage across the gate and ground of each transistor, their drain currents are in the ratio of 4:2:1:1.

Thus, in FIG. 11, for the same gate-source voltage (Vx) given to the deflection control node, the drain current of each transistor M2, . . . , M17, is proportional to those numbers in the parentheses.

The source of the transistor M1 whose drain is connected to the resistor Rh-B, and the sources of the transistors M2, . . . , M17 which are used as constant current supplies for the CM circuits are connected to the ground (GND).

Next, regarding the operation of the ejection-control circuit 50, at first, the current-mirror circuit composed of the transistors M4 and M6, and the transistors M3 and M5 used as a switching element therefor are described below.

Only when the ejection-executing input switch A has the state "1" (ON), an ink droplet is ejected. In this embodiment, when an ink droplet is ejected from one nozzle 18, the ejection-executing input switch A is set to be in the state "1" (ON) during a period of 1.5 microseconds (1/64), and the power supply Vh (approximately 9 V) supplies power to the resistors Rh-A and Rh-B. 94.5 microseconds (63/64) are assigned to a period in which an ink cell 12 having ejected an ink droplet is refilled with ink, with the ejection-executing input switch A set to be in the state "0" (OFF).

For example, when the ejection-executing input switch A is in the state "1", the deflection-amplitude control terminal B has the voltage Vx (analog voltage), the deflection-direction switch C is in the state "1", and the deflection-control switch J3 is in the state "1", the output of the output of the XNOR gate is "1". Thus, this output "1" and the state "1" of the ejection-executing input switch A are input to the AND gate X2, and the output of the AND gate X2 is 1. Hence, the transistor M3 is turned on.

When the output of the XNOR gate is "1", the output of the NOT gate X11 is "0". Thus, this output "0" and the state "1" of the ejection-executing input switch A are input to the AND gate X3, so that the output of the AND gate X3 is "0" and the transistor M5 is turned off.

Accordingly, since the drains of the transistors M4 and M3 are connected to each other and the drains of the transistors M6 and M5 are connected to each other, when the transistor M3 is in ON state and the transistor M5 is in OFF state, a current flows from the resistor Rh-A to the transistor M3, but no current flows to the transistor M6 due to the OFF state of the transistor M5. Also, when no current flows to the transistor M6, no current also flows to the transistor M4 due to the characteristics of the current-mirror circuit. Since the transistor M2 is in ON state, in the above case, among the transistors M3, M4, M5, and M6, a current only flows from the transistor M3 to M2.

In this state, no current flows in the transistors M4 and M6. Since a current can flow through the transistor M3, a current passing through the resistor Rh-A branches off to the transistor M3 and the resistor Rh-B. The current passing through the transistor M3 passes through the transistor M2, which is in ON state, and is led to the ground. The current passing through the resistor Rh-B passes through the transistor M1, which is in ON state, and is led to the ground. Thus, the relationship in flowing current between both resistors is I(Rh-A)>I(Rh-B), where the representation "I(XX-X)" represents a current flowing through XX.

A case in which the deflection-control switch J3 is in the state 1 has been described. Under the above conditions, a case in which the deflection-control switch J3 is in the state "0", that is, the deflection-control switch J3 has a different input (while switches A and C are set to be in the state 1 similarly to the above), is as follows:

In this case, the output of the XNOR gate X10 becomes "0". This causes the AND gate X2 to have "0" and "1" as inputs, so that its output is "0". Thus, the transistor M3 is turned off.

When the output of the XNOR gate X10 is "0", the output of the NOT gate X1 is "1". Thus, the inputs of the AND gate X3 are "1" and "1", thus turning on the transistor M5.

During the ON state of the transistor M5, a current flows in the transistor M6, which causes a current to flow also in the transistor M4 because of the characteristics of the CM circuit.

Thus, a current is supplied and flows in the resistor Rh-A, the transistors M4 and M6 from the power supply Vh. All the current passing through the resistor Rh-A flows in the resistor Rh-B (the current passing through the resistor Rh-A does not branch off to the transistor M3 since it is in OFF state). All the current passing through the transistor M4 flows into the resistor Rh-B since the transistor M3 is in OFF state. The current passing through the transistor M6 flows into the transistor M5.

Accordingly, when the deflection-control switch J3 is in the state"1", the current passing through the resistor Rh-A branches off to the resistor Rh-B and the transistor M3. When the deflection-control switch J3 is in the state "0", not only the current passing through the resistor Rh-A, but also the current passing through the transistor M4 flow into the resistor Rh-B. As a result, the relationship between the currents flowing in both resistors is represented by I(Rh-A)< I(Rh-B). The ratio is symmetrical in both cases (the deflection-control switch J3 is in states "1" and "0") By setting the amounts of currents flowing in the resistors Rh-A and Rh-B to differ in the above manner, a difference is generated in bubble producing time between the bisected heating resistors 13. This can change a direction in which an ink droplet is ejected.

Between the cases in which the deflection-control switch J3 is in states "1" and "0", a direction in which an ink droplet is deflected can be symmetrically switched in position to the direction in which the nozzles 18 are arranged.

Figure 12:
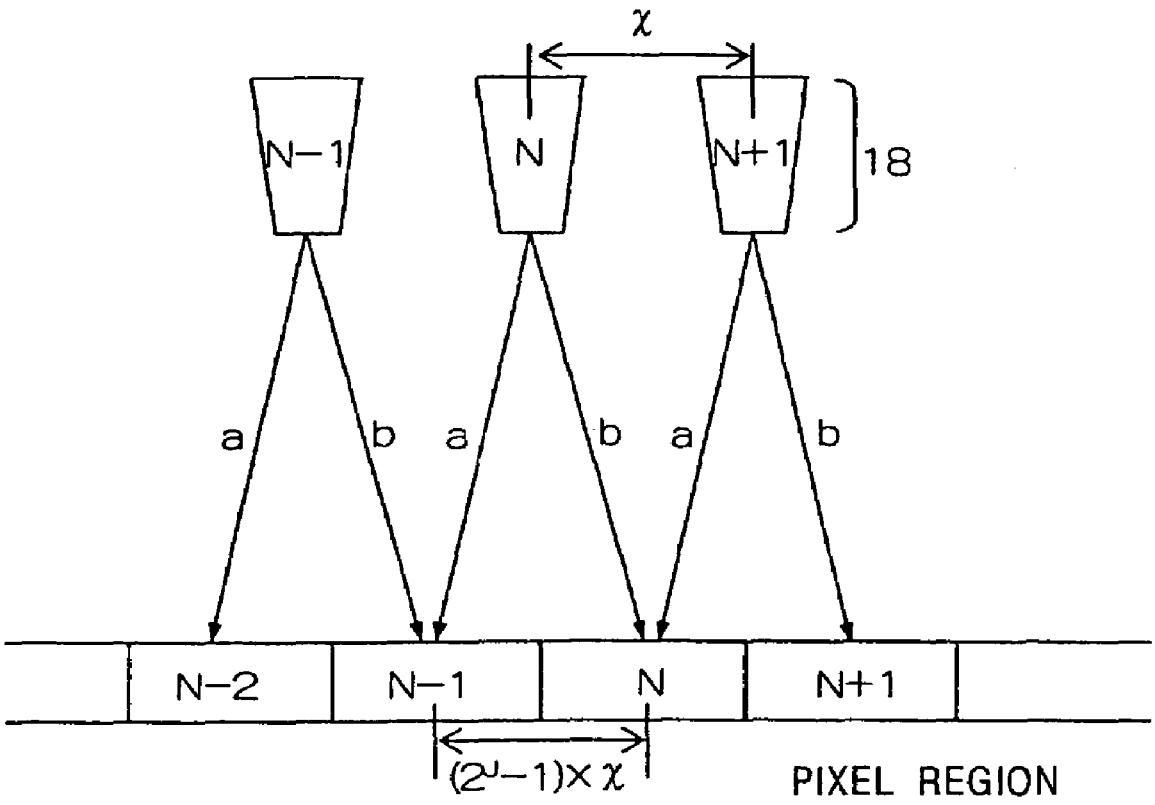
FIG. 12 is an illustration of an example in which ink droplets are delivered from ink ejecting portions adjacent to a pixel.

Accordingly, by adjusting the voltage Vx of the deflection-amplitude control terminal B, the interval between two positions to which an ink droplet is delivered, when the deflection-control switch J3 is in the state "1" and that of the deflection-control switch J3 is in the state "0", can be equal to the distance between two adjacent ink ejecting portions (the nozzles 18), and ink droplets can be delivered in a pixel region from the nozzles 18 of adjacent ink ejecting portions, as FIG. 12 shows.

This case differs from that of the first embodiment in that the positions to which the ink droplets are delivered (position of pixel columns) are become the midpoint of the nozzles 18.

The above description applies to a case in which the deflection-control switch J3 only is switched on or off. If switches J2 and J1 are also engaged mixedly with J3, the amounts of the currents flowing in the resistors Rh-A and Rh-B can be set with a finer step.

More specifically, by using the deflection-control switch J3, the current flowing in the transistors M4 and M6 can be controlled. By using the deflection-control switch J2, the current flowing in the transistors M9 and M11 can also be controlled. Further, by using the deflection-control switch J1, currents flowing in the transistors M14 and M16 can be controlled.

As described above, drain currents can be supplied to the transistors M4 and M6, the transistors M9 and M11, and the transistors M14 and M16 in the ratio of 4:2:1. Therefore, by using three bits, namely, the deflection-control switches J1 to J3, the direction in which the ink droplet is deflected can be changed to eight steps in which (J1-state, J2-state, J3-state)=(0, 0, 0), (0, 0, 1), (0, 1, 0), (0, 1, 1) , (1, 0, 0) , (1, 0, 1) , (1, 1, 0), and (1, 1, 1).

By changing the voltage applied between the gates of the transistors M2, M7, M12, and M17 and the ground, the amounts of the currents can be changed. Thus, an amount of deflection in one step can be changed by changing the drain currents in those transistors while maintaining their ratio as 4:2:1.

Accordingly, when ejection of ink droplets is deflected to an even number of 2J different directions by using a control signal represented by J bits (in the second embodiment, by J1, J2, and J3 bits, the distance between the two farthest positions of the dots delivered from the same ink ejecting portion is $(2^J-1)$ times that of the distance between two adjacent ink ejecting portions (the nozzles 18). (J=1 case is shown in FIG. 12) Thus, in the case of the second embodiment, any one of the $2^J$ directions for ejection of ink droplets can be selected and ink droplets can be delivered in any one of eight pixel regions in the direction of the arranged nozzles 18.

The deflection-angle correcting switches S and K are similar to the deflection-control switches J1 to J3 in switch for changing the direction of ink-droplet ejection, but differ in the purpose of use in correcting the angle of ejection of ink droplet. Switches S and K can be controlled independently from Switches J. In this embodiment, two bits which form the deflection-angle correcting switches S and K are used for correction.

The ejection-angle correcting switch K is used to determine whether or not correction is performed. The ejection-angle correcting switch K is set so that correction is performed when its state is "1" and-no correction is performed when its state is "0".

The deflection-angle correcting switch S is used to determine in which the correction of the direction on the arranged nozzles 18 is performed.

For example, when the ejection-angle correcting switch K is in the state "0" (no correction is performed), both the outputs of the AND gates X8 and X9 are "0s" since at least one input of each of the AND gates X8 and X9 is "0". Thus, the transistors M18 and M20 are turned off, which turns off the transistors M19 and M21. This causes no change in the currents flowing in the resistors Rh-A and Rh-B.

Conversely, when the ejection-angle correcting switch K is in the state "1" while the deflection-angle correcting switch S is in the state "0", and the deflection-direction switch C is in the state "0", the output of the XNOR gate X16 is "1". Thus, all three inputs of the AND gate X8 are fed by "1"s, which makes its output at "1" state, and turns on the transistor M18. Since one of the inputs of the AND gate X9 is set to "0" by the NOT gate X17, the output of the AND gate is "0", thus turning off the transistor M20. Therefore, the OFF state of the transistor M20 causes no current to flow in the transistor M21.

The characteristics of the current-mirror circuit cause no current to flow also in the transistor M19. However, the ON state of the transistor M18 causes a current to flow from the midpoint of the resistors Rh-A and Rh-B into the transistor M18. Thus, the current in the resistor Rh-B can be reduced than that in the resistor Rh-A. Accordingly, the angle of ejection of ink droplet is corrected and the position to which the ink droplet is delivered can be corrected by a predetermined amount in the direction in which the nozzles 18 are arranged.

The above correction is performed in units of ink ejecting portions or in units of heads 11. It is common that directions in which ink droplets are ejected from the ink ejecting portions of one head 11 are not always constant but fluctuating. Normally, the range of the error (fluctuation) is defined, and when each direction (position to which an ink droplet is delivered) of ejection of ink droplet is within a predetermined range, the direction is treated as normal. However, for example, a shift in the direction in which an ink droplet is ejected from one ink ejecting portion becomes too large compared with the other ink ejecting portions, the uniformity of an ink-droplet delivery pitch deteriorates, appearing in the form of a stripe. To correct such a positional shift, correction for each ink ejecting portion is performed (the direction of ejection is changed).

Regarding the correction of the direction of ink-droplet ejection, once a correct position to which an ink droplet is delivered is obtained within the predetermined range, the amount of correction does not need to be re-adjusted unless the characteristics of the direction of ejection change with time.

Accordingly, it is necessary to determine for which of the ink ejecting portions of one head 11, correction must be performed, or for which of the heads 11, correction must be performed, and how much correction is needed in the case which requires correction. For matching the determined correction, the deflection-angle correcting switches S and K may be turned on or off.

As described above, by setting the deflection-direction switch C to have an input of the state "1" or "0", the deflection direction can be symmetrically changed in position in the direction in which the nozzles 18 are arranged.

In the line head 10 in the second embodiment, as in example in FIG. 10, the heads 11 (having identical specifications or structures) are arranged in the width direction of printing paper and are arranged in a repeated pattern so that two adjacent heads 11 can oppose each other (every other head 11 is disposed with it rotated 180 degrees with respect to the adjacent head 11). In this case, when a common signal is sent to J1 through to J3 to the two adjacent heads 11 from the deflection-control switches, the deflection directions in either head are opposing to those of the other head. In the second embodiment, by providing the same status ("1" or "0") to the deflection-direction switch C of every other head chip, the direction of deflection in the entire head 11 can be made virtually identical to the common signal given at J1 through to J3.

Accordingly, when a line head is formed by arranging the heads 11 in the repeated pattern, the deflection-direction switch C is set to be in the state "0" for heads N, N+2, N+4, etc., for example, in the even-numbered positions among the heads 11, and the deflection-direction switch C is set to be in the state "1" for the odd-numbered heads N+1, N+3, N+5, etc., whereby the direction of deflection in each head in the line head 20 can be set to be virtually constant.

Figure 13:
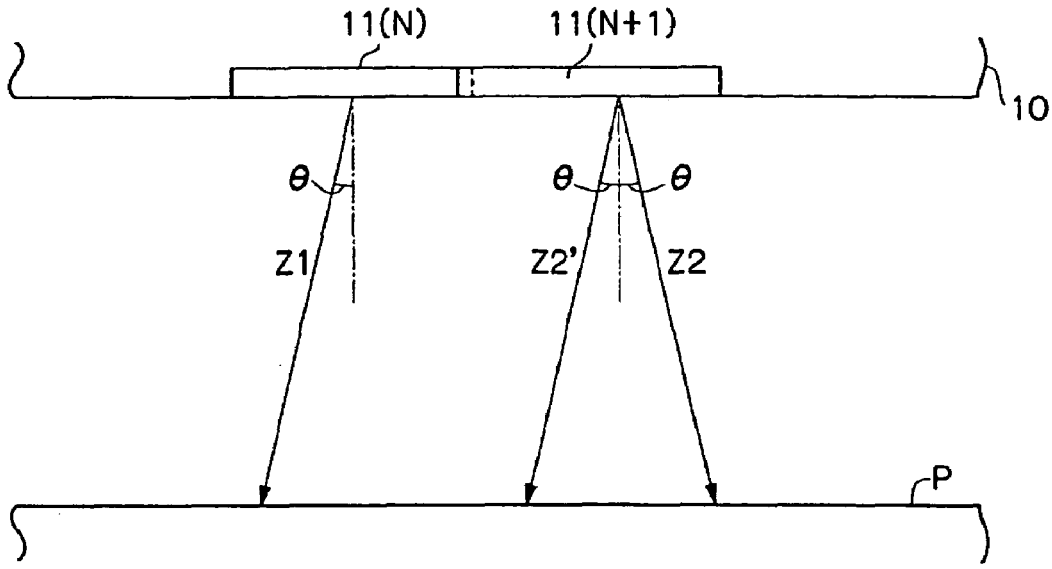
FIG. 13 is a front view showing directions in which ink droplets are delivered from adjacent heads in an alternate pattern arrangement.

FIG. 13 is a front view showing directions in which ink droplets are ejected from adjacent heads 11 arranged in the repeated pattern. The adjacent heads 11 are referred to as heads N and N+1, respectively. If the deflection-direction switch C is not provided in this case, by setting each of the heads N and N+1 to deflect the direction of ink-droplet ejection by θ from perpendicularity, as FIG. 13 shows, both heads have such symmetrical directions of ejection that the direction of ejection from the head N is changed to direction Z1 and the direction of ejected from the head N+1 is changed to direction Z2 because the heads N and N+1 are positioned so that every other head is disposed which it rotated 180 degrees with reference to the other.

However, as in the second embodiment, by providing the deflection-direction switch C, and, for example, setting the deflection-direction switch C to be in the state "0" for the head N and setting the deflection-direction switch C to be in the state "1" for the head N+1, the direction of ejection from the head N can be changed to direction Z1 and the direction of ejection from the head N+1 can be changed to direction Z2', so that the direction of ejection can be set to be constant in the direction in which the nozzles 18 are arranged.

As described above, by supplying identical deflection signals for the other switches and changing only the input of the deflection-direction switch C, the directions of ejection from the heads 11 arranged in the repeated pattern can be identically set.

A case in which ejection of an ink droplet is set to an even number of $2^J$ different directions has been described. In the ejection-control circuit 50, by setting the deflection-amplitude control terminal B to have values of zero or Vx (DC value in volt in this case), ejection of an ink droplet from the nozzle 18 can be set to have an odd number of directions. In other words, by setting the deflection-amplitude control terminal B to have Vx, as described above, ejection of the ink droplet is set to have an even number of directions composed of equal numbers of right and left directions in the direction of the arranged nozzles 18. In addition, by setting the deflection-amplitude control terminal B to have zero, an ink droplet can be ejected directly below with no deflection which delivers the droplet out of the nozzle 18. Therefore, by using deflected ejection of the ink droplet to equal numbers of right and left directions, and ejection of the ink droplet with no deflection, an odd number of directions for ejection can be realized (see FIG. 14).

Figure 14:
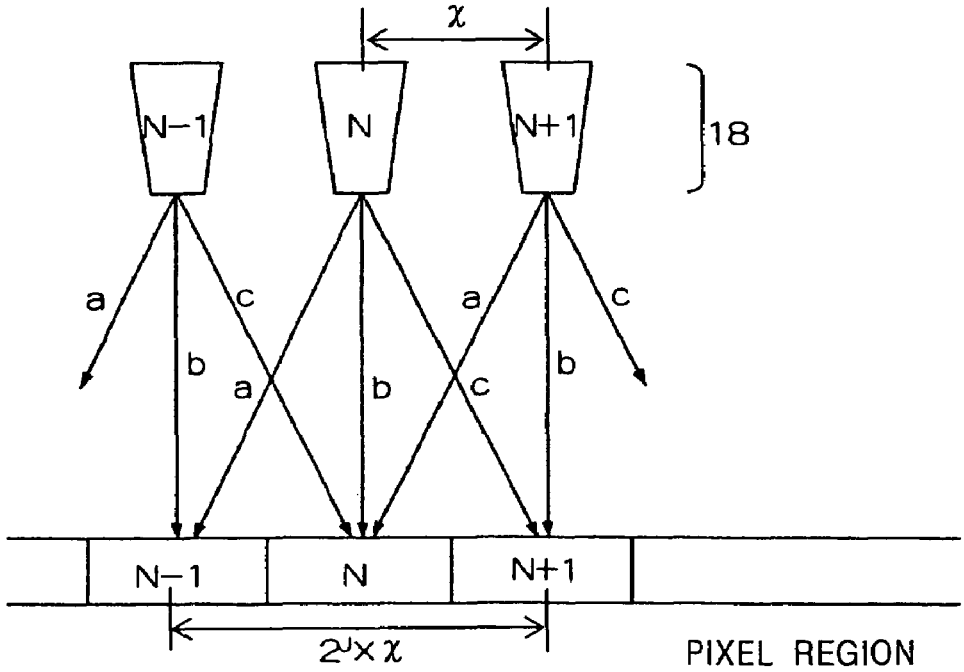
FIG. 14 is an illustration of an example of setting an odd number of directions for ejection by using deflected ejection of ink droplets in right and left symmetric directions and directly-below ejection of ink droplets.

In this case, a control signal is represented by (J $(2^J)$+1) bits, and the number of directions for ejection is an odd number of $(2^J+1)$ different directions. Here, ink droplet ejection may be set so that, by adjusting the value of the deflection-amplitude control terminal B (=Vx), among the $(2^J+1)$ directions, the distance between the two farthest positions to which an ink droplet can be delivered is $2^J$ times ($2^J\chi$ where J=1 case is shown in FIG. 14) the distance ($\chi$ in FIG. 14) that is the distance between two ink ejecting portions (the nozzles 18), and when an ink droplet is ejected, any one of the $(2^J+1)$ directions may be set.

This makes it possible to deliver ink droplets not only to a pixel region N positioned under the nozzle N, but also to adjacent pixel regions N−1 and N+1 on both sides thereof.

Also, each position to which an ink droplet is delivered corresponds in position to each nozzle 18.

By using the above ejection deflector instead of the ejection deflector in the first embodiment, setting of the direction of ejection is facilitated compared with that in the first embodiment, and various direction of ejection can be set.

Figure 15:
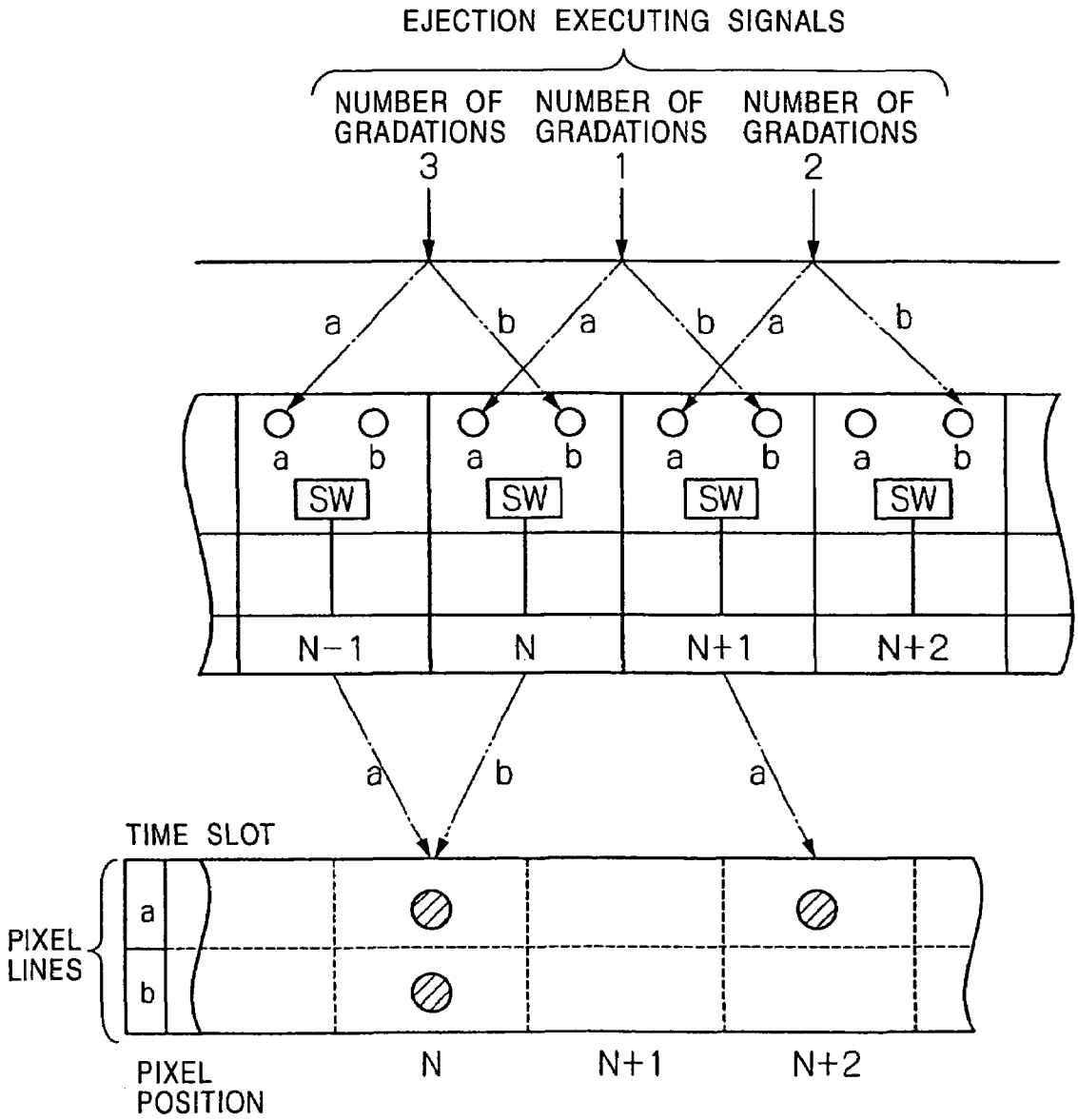
FIG. 15 is an illustration of a process of forming pixels on printing paper by ink ejecting portions based on ejection-executing signals in the case of two-directional ejection (the number of directions for ejection is even)
Figure 16:
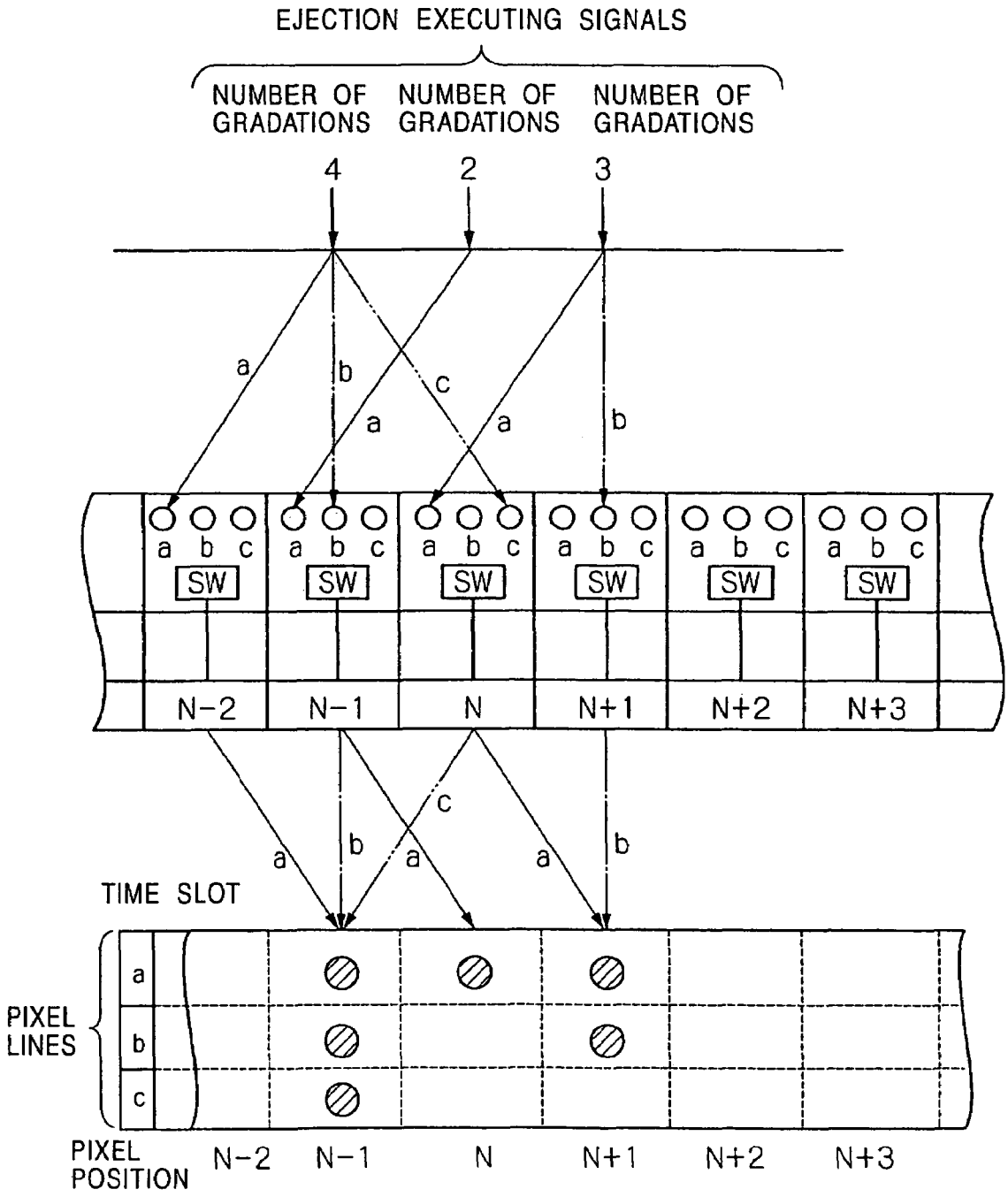
FIG. 16 is an illustration of a process of forming pixels on printing paper by ink ejecting portions based on ejection-executing signals in the case of three-directional ejection (the number of directions for ejection is odd)

FIGS. 15 and 16 respectively show processes in which, in the two-directional ejection case (the number of directions for ejection is even) and in the three-directional ejection case (the number of directions for ejection is odd) where pixels are formed on printing paper based on an ejection-executing signal sent to the head 11 by ink ejecting portions, which correspond to FIG. 9 of the first embodiment. Since the pixel forming processes in FIGS. 15 and 16 are similar to that described using FIG. 9, descriptions thereof are omitted.

As described above, by using the ejection deflector in the second embodiment, as FIGS. 15 and 16 show, various forms of ejection-executing signals sent to the head 11 can be set in the process by the ink ejecting portions of forming each pixel on the printing paper.

Third Embodiment

In the second embodiment, by setting the input to the deflection-amplitude control terminal B to zero so that an ink droplet is ejected without being deflected. A form in which this ejection control is facilitated is the ejection-control circuit 50A shown in FIG. 17.

Figure 17:
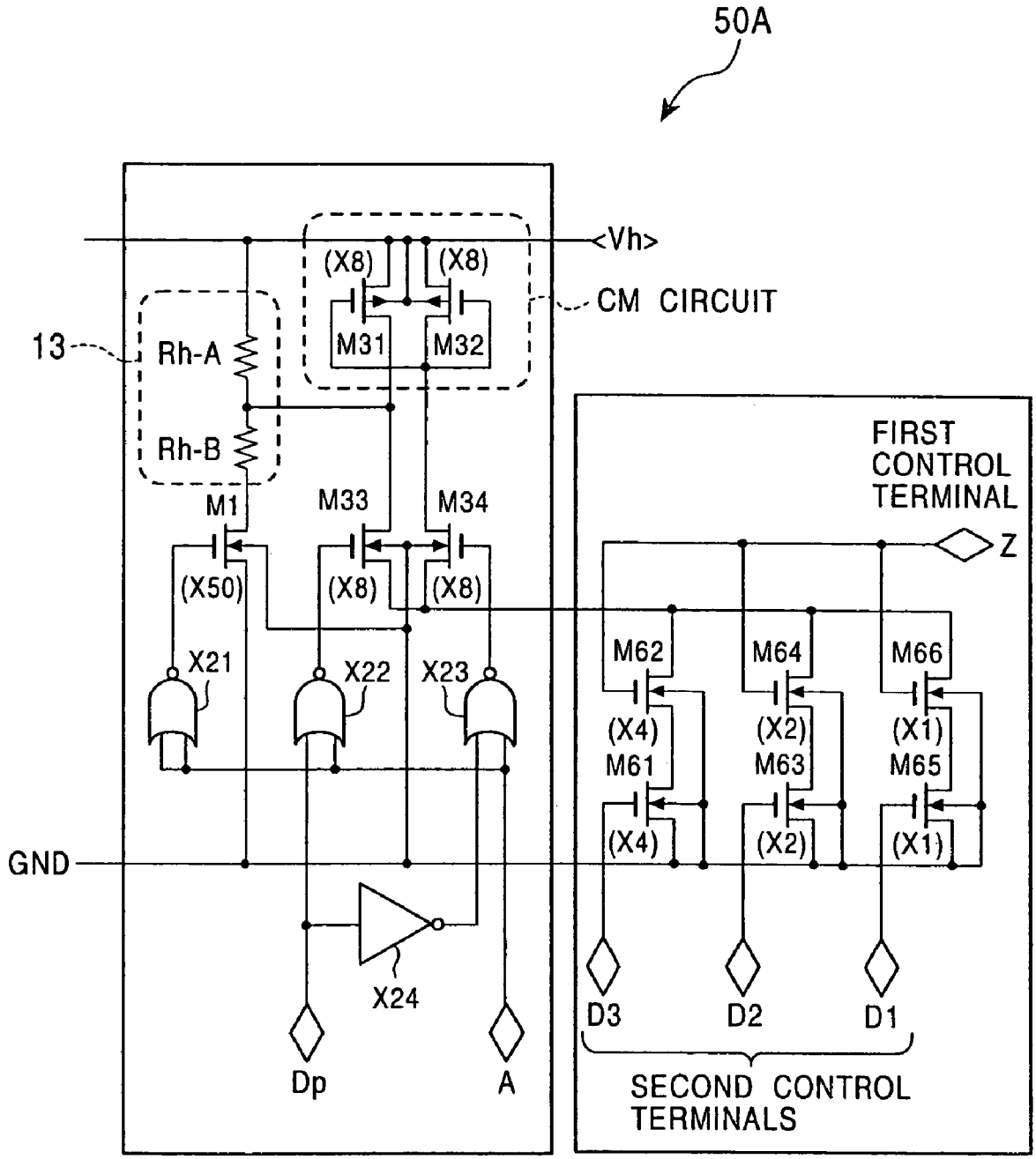
FIG. 17 is a circuit diagram showing an ejection-control circuit in a third embodiment of the present invention.
Figure 18:
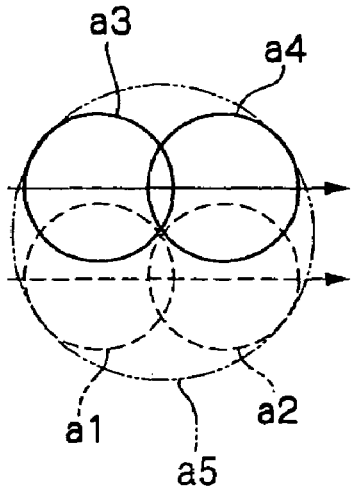
FIG. 18 is an illustration of a method by superimposition, which is a first example of a related method.
Figure 19:
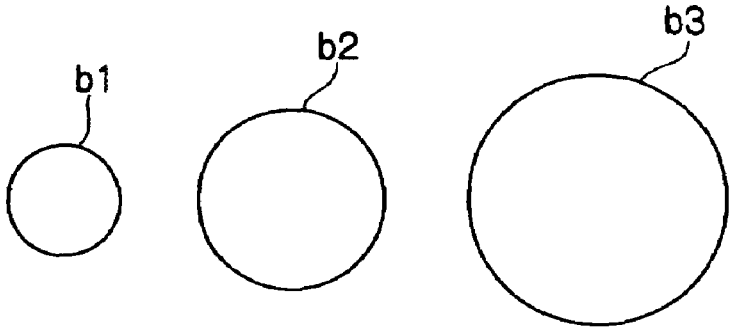
FIG. 19 is an illustration of a method by droplet amount, which is a second example of the related method.
Figure 20:
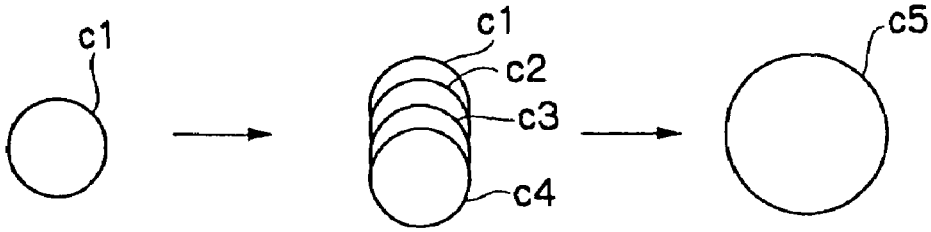
FIG. 20 is an illustration of a method by the number of dots, which is a third example of the related method.

Although the ejection-control circuit 50 in FIG. 11 includes four CM circuits, the ejection-control circuit 50A in FIG. 17 includes only a single CM circuit (composed of transistors M31 and M32), whereby simplification of the entire circuit structure is achieved. In the four CM circuits in FIG. 11, the transistors M4 and M6 are represented by "X4" (number of transistors in parallel), the transistors M9 and M11 are represented by "X2", and the transistors M14 and M16 and the transistors M19 and M21 are represented by "X1", in the ejection-control circuit 50A in FIG. 17, devices represented by "X8" are used for the transistors M31 and M32 so as to drain current capacities of those transistors equal to the sum of the drain current capacity of all the above transistors in the ejection-control circuit 50.

When "X8" devices are used as the transistors M31 and M32, it looks they require large space on the silicon.

However, if individual transistors are disposed in the same circuit, eight wiring terminals are needed for each. transistor since it has a drain, a source, etc. Accordingly, as compared with the case of disposing eight individual transistors and associated wirings, the case of employing "X8" single transistor greatly reduces the required area for the entirety, even if the transistor itself occupies relatively a large space.

Therefore, by forming a single CM circuit as in the ejection-control circuit 50A in FIG. 17, the entire circuit structure can be simplified, performing similar functions to those in the ejection-control circuit 50 in FIG. 11.

The switching element (second switching element compared with first switching by transistor M1) of this current-mirror circuit only consists of transistors M33 and M34. In other words, four sets of the second switching elements as seen in FIG. 11 are not provided in the third embodiment, and only one set of the second switching element is provided instead. In FIG. 11, the transistors M3 and M5 are represented by "X4", the transistors M8 and M10 are represented by "X2", and the transistors M13, M15, M18 and M20 are represented by "X1". On the contrary, devices represented by "X8" are used for the transistors M33 and M34 so as to provide with enough drain current capacity equal to the sum of those of all the above transistors in FIG. 11.

The source and backgate of the transistor M1 are connected to the ground. The sources of the transistors M33 and M34 are connected to the common circuit (current source) to be described later, and their backgates are connected to the ground. Each output of the NOR gates X21, X22, and X23 are connected to the gates of the transistors M1, M33, and M34, respectively.

The ejection-control circuit 50A includes a circuit including current-source unit for supplying currents to the transistors M33 and M34. The circuit includes a first control terminal Z, second control terminals D1, D2, and D3, and transistors M61 through to M66.

The current-source unit consist of three current-source elements. In other words, by connecting, in parallel, (1) the current-source element composed of the transistor M62, which has a (current) capacity represented by "×4", (2) the current-source element composed of the transistor M64, which has a (current) capacity represented by "×2", and (3) the current-source element composed of the transistor M66, which has a (current) capacity represented by "×1", the current-source unit is formed.

Also, transistors (the transistors M61, M63, and M65) having identical current capacities to those of the transistors constituting the current-source elements are connected as the switching elements of the current-source. The second control terminals D3 through to D1 are connected to the gates of the transistors forming the switching elements.

The resistors Rh-A and Rh-B, the transistor M1, and the ejection-executing switch A are identical to those shown in FIG. 11.

In the ejection-control circuit 50A in FIG. 17, an ejection-executing input switch A uses a negative logic for convenience of the IC design in the third embodiment. Hence, in activating ejections, "0" is input to the ejection-executing input switch A.

Accordingly, when "0" is input to the ejection-executing input switch A, and 0s are input to a NOR gate X21, its output becomes "1", thus turning on the transistor M1.

When the input of the ejection-executing input switch A is "0", by inputting "0" to the polarity-change switch Dp, both inputs of the NOR gate X22 are "0"s, the output of X22 becomes "1". This turns on the transistor M3. In the above case (the ejection-executing input switch A is in the state "0" and the polarity-change switch Dp is in the state "0"), as the inputs of a NOR gate X23 are "1" and "0", the output becomes "0", thus turning off a transistor M34.

In this case, no current flows from the transistor M32 to M34, so based on the characteristics of the CM circuit, no current flows to the transistor M31.

In this state, when the voltage of the resistor power supply Vh is applied, since a current flows in the transistor M33, a current flows from a point between Rh-A and Rh-b to transistor M33. As a result of fact, a current of Rh-A is increased, and a current of Rh-b is decreased. The current passing through the transistor M33 is sent to the ground. The current passing through the resistor Rh-B flows to the ground through the transistor M1. Thus, the currents through the resistors Rh-A and Rh-B has a relationship of I(Rh-A) >I(Rh-B).

When "0" is input to the ejection-executing input switch A and "1" is input to the polarity-change switch Dp, both inputs of the NOR gate X21 are "0"s similarly to the previous case, therefore, the output of X21 becomes "1", thus turning on the transistor M1.

Also, since the inputs of the NOR gate X22 are "1" and "0", its output becomes "0", thus turning off the transistor M33. Since both inputs of the NOR gate X23 are "0"s, its output is "1", thus turning on the transistor M34. During the ON state of the transistor M34, a current flows through the transistor M34, and this flow of the current and the characteristics of the CM circuit allow a current to flow also in the transistor M31.

Therefore, in addition to the current passing through the resistor Rh-A, the current passing through the transistor M31 flows into the resistor Rh-B. As a result, the current through the resistors Rh-A and that of the Rh-B have a relationship I(Rh-A)<I(Rh-B).

Accordingly, similarly to the ejection-control circuit 50 in FIG. 11, the current enabling the deflection can be drawn from, or flow into the midpoint of the resistors Rh-A and Rh-B.

The ejection-control circuit 50A in FIG. 17 differs from that of the circuit 50 in FIG. 11 in the following points:

In the ejection-control circuit 50A, by inputting "1" or "0" to each of the second control terminals, the value of a current output from the current-source units can be changed. By changing a voltage applied to the first control terminal Z, scaling of the output current value can be arbitrarily performed.

Therefore, by applying an appropriate voltage Vx across the first control terminal Z and the ground, and separately operating the control terminals D1 through to D3, the output current value can be controlled in eight steps from 0 (Id) to 7 (Id), with the drain current Id used as a step (when the value of Dp is maintained at some fixed level). Moreover, since a change in the applied voltage Vx can change the drain current Id (of all transistors associated with Vx), the entire current can also be changed proportionally.

Also, since a polarity-change switch Dp is provided in addition to the three second control terminals D1, D2, and D3, the total number of bits is four.

Therefore, the ejection-control circuit 50A in FIG. 17 takes fifteen output current values from −7 to +7 (×Id) in increments of 1 with one overlap at Id=0 that happens when all J1 through to J3 bits are "0", and changes differently from the ejection-control circuit 50 in FIG. 11.

Thus, the number of settable output current values is odd, including zero (no deflection).

Accordingly, in the second embodiment, by setting the analog input value of the deflection-amplitude control terminal B to zero, a state is created in which an ink droplet is ejected without being deflected. In the third embodiment, an ink droplet is ejected without being deflected under control of the second control terminals D1, D2, and D3, and the polarity-conversion switch Dp, with the input value of the first control terminal Z maintained at some appropriate level.

Also, in the ejection-control circuit 50A in the third embodiment, by always supplying the second control terminal D1 (LSB) with the input "1" (the case of the second control terminal D1 being "0" is eliminated), the number of output current values can be set to an even number.

The embodiments of the present invention have been described. However, the present invention can be variously modified as shown below without being limited to the embodiments described herein.

(1) For example, in the first embodiment, by using a control signal represented by J bits, an ink droplet is deflected in an even number of $2^J$ different directions, and the distance between the two farthest positions to which the ink droplet is delivered is set to $(2^J-1)$ times the interval between two adjacent nozzles 18.

However, the setting is not limited thereto, but by using a control signal represented by J+K (bits), the ink droplet can be deflected in an even number of $2^{(J+K)}$ different directions, the distance between the two farthest positions to which the ink droplet is delivered can be set to $(2^J-1)$ times the interval between two adjacent nozzles 18, and the position to which the ink droplet is delivered can be changed at intervals of $1/2^K$ of the interval between two adjacent nozzles 18.

This can use K bits as a control signal for correction. In other words, when K is set to, for example, 2 for correcting a positional shift from the correct position to which the ink droplet is delivered, the position to which the ink droplet is delivered can be changed at intervals of $1/2^K$ (=¼) of the interval between two adjacent nozzles 18. By supplying a K-bit control signal to the internal memories of each ink ejecting portion when power is initially supplied, for example, the ink ejecting portion can eject an ink droplet, based on the K-bit control signal which is set in the memories and not changed during printing, plus the J-bit control signals which are supplied in accordance with ink droplet ejection command.

(2) In the first embodiment, an example of J=2 case (in FIG. 6, J=1 and 2) has been described so that the functions of J-bit control signal can be understood. In the second embodiment, an example of J=3 has been described, where control signals of J=3 or more may be used. This similarly applies to the case of the above K-bit control signal.

(3) In the above embodiments, by changing the balance of currents flowing in the bisected heating resistors 13, the times (bubble producing time) required for the ink droplets to boil have a difference. The present invention is not limited thereto, but timings with which currents are supplied to bisected heating resistors 13 having equal resistances may be set to differ. For example, by providing the two heating resistors 13 with separate switches, and turning on each switch with a slight difference in time, the time required for ink of each heating resistor 13 to boil can differ. Moreover, changing the current flowing in each heating resistor 13, and the setting of the durations of the flows of the currents to differ can be used in combination.

(4) The above embodiments show a case in which two heating resistors 13 are arranged in a single ink cell 12. The reason of bisection is that the elements' durability has been sufficiently demonstrated and the circuit configuration can also be simplified. However, the present invention is not limited thereto. The arrangement in parallel of at least three heating resistors 13 (energy generating elements) in a single ink cell 12 can be used.

(5) In the above embodiments, the heating resistors 13 are shown as energy generating elements of a thermal type. However, heating resistors composed of a substance other than a resistor may be used. The energy generating elements are not limited to heating resistors, but other types of energy generating elements may be used. For example, energy generating elements of an electrostatic ejection type and a piezoelectric type can be used.

The energy generating element of the electrostatic ejection type includes a vibrator, and two electrodes provided to the lower side of the vibrator, with an air layer provided therebetween. A voltage is applied across both electrodes, thus causing the vibrator to warp downward, and after that, by changing the voltage to zero volts, electrostatic force is released. Then, elastic power generated when the vibrator returns to the original state is used to eject an ink droplet.

In this case, in order for the generation of energy in each energy generating element to differ, for example, when the vibrator is returned to the original state (electrostatic power is released by changing the voltage to zero volts), two energy generating elements may have a difference in time, or the applied voltages may be set to differ between the energy generating elements.

The energy generating element of the piezoelectric type has a layered structure composed of a piezoelectric element having electrodes on two surfaces thereof and a vibrator. By applying a voltage to the electrodes on both surfaces of the piezoelectric element, a piezoelectric effect produces a bending moment in the vibrator, so that the vibrator warps and is deformed. This deformation is used to eject an ink droplet.

Also, in this case, similarly to the above, in order for the generation of energy in each energy generating element to differ, when the voltage is applied to the electrodes on both electrodes, two piezoelectric elements may be controlled to have a difference in time, or the applied voltages may be set to differ for the two piezoelectric elements.

(6) In the above embodiments, the ink droplet can be deflected in a direction in which the nozzles 18 are arranged. This is because the heating resistors 13 divided in the direction in which the nozzles 18 are arranged are arranged in parallel. However, the direction in which the nozzles 18 are arranged and the direction of deflecting the ink droplet do not always coincide with each other. Even if both have some shift, an advantage can be expected which is substantially identical to the case of complete coincidence between the nozzles 18 are arranged and the direction of deflecting the ink droplet. Accordingly, there is no problem if the shift occurs.

(7) In the above embodiments, the head 11 for use in a printer are shown as examples the head 11 of the present invention is not limited to the printer, but can be applied to various liquid ejecting devices. For example, the head 11 can also be applied to a device for ejecting a DNA-containing solution for detecting a biological sample.

According to the present invention, by using a plurality of different liquid ejecting portions, a pixel or a pixel column can be formed. Thus, differences in the quantities of ink droplets from the liquid ejecting portions can be minimized, thus preventing a decrease in printing quality.

If there is a liquid ejecting portion from which an insufficient ink droplet is ejected or an ink droplet cannot be ejected due to dirt, dust, etc., the influence can be minimized. This can increase printing quality by a head that should normally be regarded as defective to a normal head level.

In addition, instead of providing a backup head, even if there is a liquid ejecting portion that cannot eject a droplet, another adjacent liquid ejecting portion compensates for the defective liquid ejecting portion and can eject a droplet therefor.

Moreover, in the case of forming a pixel by using a plurality of droplets, the droplets can be delivered so as to overlap one another without moving a head a plural number of times (without performing scanning a plural number of times). This can increase the printing speed.

What is claimed is:

1. A liquid ejecting device having at least one head including a plurality of liquid ejecting portions each having a nozzle, said liquid ejecting device comprising:

an ejection deflector for ejecting a droplet with deflection for each nozzle of said plurality of liquid ejecting portions in a plurality of directions in which the nozzles of said plurality of liquid ejecting portions are arranged; and an ejection controller for controlling the droplets that are delivered in a single column to form a pixel column, or the droplets are delivered in a single pixel region to form a pixel by ejecting droplets in different directions from at least two different liquid ejecting portions among said plurality of liquid ejecting portions while using said ejection deflector, such that a plurality of said droplets are selectively transmitted toward a desired location and a number of droplets selectively positioned at the desired location is altered to express a graduation in image information.

2. A liquid ejecting device according to claim 1, wherein:

said ejection deflector is set so that the droplets ejected with deflection from the nozzle of each or the liquid ejecting portions are delivered in an even number of different positions, represented by $2^J$, based on a control signal represented by J bits, where J represents a positive integer, and the distance between the two farthest positions to which the droplets from the same nozzle are delivered, in the $2^J$ directions, can be $(2^J-1)$ times the interval between two adjacent nozzles among the nozzles; and said ejection controller selects one of the $2^J$ directions when the droplets are ejected from the nozzle of each of said plurality of liquid ejecting portions.

3. A liquid ejecting device according to claim 1, wherein:

said ejection deflector is set so that the droplets ejected with deflection from the nozzle of each of said plurality or liquid ejecting portions are delivered in an odd number of different positions, represented by $(2^J+1)$, based on a control signal represented by (J+1) bits, where J represents a positive integer, and the distance between the two farthest positions to which the droplets are delivered from the same nozzle in the $(2^J+1)$ directions, can be $2^J$ times the interval between two adjacent nozzles among the nozzles; and said ejection control means selects one of the $(2^J+1)$ positions when the droplets are ejected from the nozzle of each of said plurality of liquid ejecting portions.

4. A liquid ejecting device according to claim 1, wherein:

said ejection deflector is set so that the droplets ejected with deflection from the nozzle of each of said plurality of liquid ejecting portions are delivered in an even number of different positions, represented by $2^{(J+K)}$, based on a control signal given by (J+K) bits, where both J and K represent positive integers, and so that the distance between the two farthest positions to which the droplets from the same nozzle are delivered, in the $2^J$ directions, can be $(2^J-1)$ times the pitch of die nozzles, and the position to which the ejected droplets arc delivered can be chosen at $1/2^K$ times the pitch of the adjacent nozzles; and said ejection control means selects one of the $2^{(J+K)}$ positions when the droplets are ejected from the nozzle of each of said plurality of liquid ejecting portions.

5. A liquid ejecting device according to claim 1, wherein:

said ejection deflector is set so that the droplets ejected with deflection from the nozzle of each of said plurality of liquid ejecting portions are delivered in an odd number of different positions, represented by $(2^{(J+K)}+1)$, based on a control signal represented by (J+K+1) bits, where both J and K represent positive integers, and so that the distance between the two farthest positions to which the droplets from the same nozzle are delivered, in the $(2^J+1)$ directions, can be $2^J$ times the interval between two adjacent nozzles among the nozzles, and the position to which the ejected droplets are delivered can be chosen at $1/2^K$ times the pitch of the nozzles; and said ejection controller selects one of the $(2^{(J+K)}+1)$ directions when the droplets are ejected from the nozzle of each of said plurality of liquid ejecting portions.

6. A liquid ejecting device according to claim 1, wherein, when a pixel formed by delivering at least one droplet in die M-th line of a single column in the direction of the arranged liquid ejecting portions, where M represents a positive integer, and a pixel formed by delivering at least one droplet in the (M+1)-th line of said single pixel column are arranged, said ejection controller controls ejection so that a liquid ejecting portion among said plurality of liquid ejecting portions which is used for the first ejection to form the pixel in the M-th line, and a liquid ejecting portion among said plurality of liquid ejecting portions which is used for the first ejection to form the pixel in the (M+1)-th line shall be different.

7. A liquid ejecting device according to claim 1, wherein, when a pixel formed by delivering at least one droplet in the M-th line in a single pixel column in a direction of the arranged liquid ejecting portions, where M represents a positive integer, and a pixel formed by delivering at least one droplet in the (M+1)-th line in said single pixel column arc arranged, said ejection controller controls ejection so that the same liquid ejecting portion among said plurality of liquid ejecting portions is not used for the first ejection to form the pixel in the M-th line, and for the first ejection to form the pixel in the (M+1)-th line.

8. A liquid ejecting device according to claim 1, wherein said ejection controller comprises:

a liquid-ejecting-portion selecting means for selecting, based on a preset format, at least one liquid ejecting portion for use in liquid ejection from among said plurality of liquid ejecting portions; and an ejection-direction determining means for determining, based on a format conforming to said preset format, the direction in which the selected liquid ejecting portion performs droplet ejection.

9. A liquid ejecting device according to claim 1, wherein said controller means comprises deflection determining means for determining whether or not said ejection deflecting means should deflect the droplets ejected from the nozzle of each of said plurality of liquid ejecting portions.

10. A liquid ejecting device according to claim 1, wherein:

each of said plurality of liquid ejecting portions comprises:

a liquid cell for containing liquid; and a plurality of energy generating elements for generating energy for ejecting the liquid in said liquid cell from the nozzle, the energy generating elements being disposed in said liquid cell;

in said liquid cell, the energy generating elements are arranged in the direction of the arranged liquid ejecting portions; and first energy generating elements comprising at least one of said plurality of energy generating elements in said liquid cell and second energy generating elements comprising at least another one of the energy generating elements are controlled by said ejection controller to have a difference in generated energy, so that the droplets can be ejected from the nozzle with deflection based on the energy difference.

11. A liquid ejecting device according to claim 1, wherein the heads arc disposed in the direction of the arranged liquid ejecting portions Lo form a line head.

12. A liquid ejecting device having at least one head including a plurality of liquid ejecting portions each having a nozzle, said liquid ejecting device comprising:

an ejection deflector for ejecting a droplet with deflection for each nozzle of said plurality of liquid ejecting portions so that the droplets are delivered to positions in which the nozzles of said plurality of liquid ejecting portions are arranged, and to which droplets ejected from the nozzle of either adjacent liquid ejecting portion are delivered without being deflected, or the vicinity thereof; and ejection controller for controlling the droplets that are delivered in a single column to form a pixel column, or the droplets are delivered in a single pixel region to form a pixel by delivering droplets so that at least two regions to which the droplets are delivered can overlap with each other, by using al least two different liquid ejecting portions among said plurality of liquid ejecting portions and by using said ejection deflector, wherein a plurality of said droplets are selectively transmitted toward a desired location and a number of droplets selectively positioned at the desired location is altered to express a gradation in image information.

13. A liquid ejecting method using at least one head including a plurality of liquid ejecting portions each having a nozzle, wherein:

droplets are ejected from the nozzle of each of said plurality of liquid ejecting portions with deflection in a plurality of positions in the direction which the nozzles of said plurality of liquid ejecting portions are arranged; and by ejecting droplets in different directions from at least two different liquid ejecting portions in adjacent positions among said plurality of liquid ejecting portions, the droplets are delivered in a single column to form a pixel column, or the droplets are delivered in a single pixel region to form a pixel, wherein a plurality of said droplets are selectively transmitted toward a desired location and a number of droplets selectively positioned at the desired location is altered to express a gradation in image information.

14. A liquid ejecting method according to claim 13, wherein:

ejection is set so that the droplets ejected with deflection from the nozzle of each of the liquid ejecting portions is an even number of different positions, represented by $2^J$, based on a control signal represented by J bits, where J represents a positive integer, and the distance between the two farthest positions to which the droplets from the same nozzle are delivered, in the $2^J$ directions, can be $(2^J-1)$ times the interval between two adjacent nozzles among said nozzles; and one of the $2^J$ directions is selected when the droplets are ejected from the nozzle of each of said plurality of liquid ejecting portions.

15. A liquid ejecting method according to claim 13, wherein:

ejection is set so that the droplets ejected with deflection from the nozzle of each of said plurality of liquid ejecting portions is an odd number of different positions, represented by $(2^J+1)$, based on a control signal represented by (J+1) bits, where J represents a positive integer, and the distance between the two farthest positions to which the droplets from the same nozzle are delivered, in the $(2^J+1)$ directions, can be $2^J$ times the interval between two adjacent nozzles among the nozzles; and one of the $(2^J+1)$ directions is selected when the droplets are ejected from the nozzle of each of said plurality of liquid ejecting portions.

16. A liquid ejecting method according to claim 13, wherein:

ejection is set so that the droplets ejected with deflection from the nozzle of each of said plurality of liquid ejecting portions is an even number of different positions, represented by $2^{(J+K)}$, based on a control signal represented by (J+K) bits, where both J and K represent positive integers, and the distance between the two farthest positions to which the droplets from the same nozzle are delivered, in the $2^J$ directions, can be $(2^J-1)$ times the interval between two adjacent nozzles among the nozzles, and so that the position to which the ejected droplets are delivered can be chosen at $1/2^K$ times the pitch of the nozzles; and one of the $2^J$ directions is selected when the droplets are ejected from the nozzle of each of said plurality of liquid ejecting portions.

17. A liquid ejecting method according to claim 13, wherein:

ejection is set so that the droplets ejected with deflection from the nozzle of each of said plurality of liquid ejecting portions is an odd number of different positions, represented by $(2^{(J+K)}+1)$, based on a control signal represented by (J+K+1) bits, where both J and K represent positive integers, and so that the distance between the two farthest positions to which the droplets from the same nozzle are delivered, in the $(2^J+1)$ directions, can be $2^J$ times the pitch of the nozzles, and so that the position to which the ejected droplets are delivered can be chosen at $1/2^K$ times the pitch of the two adjacent nozzles; and one of the $(2^{(J+K)}+1)$ directions is selected when the droplets are ejected from the nozzle of each of said plurality or liquid ejecting portions.

18. A liquid ejecting method according to claim 13, wherein, when a pixel formed by delivering at least one droplet in the M-th line in a single pixel column in the direction of the arranged liquid ejecting portions, where M represents a positive integer, and a pixel formed by delivering at least one droplet in the (M+1)-th line in said pixel column are arranged, control is performed so tat a liquid ejecting portion among said plurality of liquid ejecting portions which is used for the first ejection to form the pixel in the M-th line, and a liquid ejecting portion among said plurality of liquid ejecting pardons which is used for the first ejection to form the pixel in the (M+1)-th line shall be different.

19. A liquid ejecting method according to claim 13, wherein, when a pixel formed by delivering at least one droplet in the M-th line of a single pixel column in a direction of the arranged liquid ejecting portions, where M represents a positive integer, and a pixel formed by delivering at least one droplet in the (M+1)-th line of said single column are arranged, a control is performed so that the same liquid ejecting portion among said plurality of liquid ejecting portions is not used for the first ejection to form the pixel in the M-th line, and for the first ejection to form the consecutive pixel in the (M+1)-th line.

20. A liquid ejecting method according to claim 13, wherein:

based on a preset format, at least one liquid ejecting portion for use in liquid ejection is selected from among said plurality of liquid ejecting portions; and based on a format conforming to said preset format, the direction in which the selected liquid ejecting portion performs droplet ejection is selected.

21. A liquid ejecting method according to claim 13, wherein determination of whether or not the droplets ejected from the nozzle of each of said plurality of liquid ejecting portions should be deflected.

22. A liquid ejecting method according to claim 13, wherein:

each of said plurality of liquid ejecting portions comprises:

a liquid cell for containing liquid; and a plurality of energy generating elements for generating energy for ejecting the liquid in said liquid cell from the nozzle, the energy generating elements being disposed in said liquid cell;

in said liquid cell, the energy generating elements are arranged in the direction of the arranged liquid ejecting portions; and first energy generating elements comprising at least one of said plurality of energy generating elements in said liquid cell and second energy generating elements comprising at least another one of the energy generating elements are controlled to have a difference in generated energy, and the droplets ejected from the nozzle are deflected based on the energy difference.

23. A liquid ejecting method according to claim 13, wherein the heads are disposed in the direction of the arranged liquid ejecting portions to form a line head.

24. A liquid ejecting method using at least one head including a plurality of liquid ejecting portions each having a nozzle, wherein:

at least one droplet is ejected from the nozzle of each of said plurality of liquid ejecting portions with deflection so that the droplet is delivered to a position to which a droplet ejected from the nozzle of another adjacent liquid ejecting portion is delivered without being deflected, or the vicinity thereof which is in a direction in which the nozzles of said plurality of liquid ejecting portions are arranged; and when a pixel column or a pixel is formed by delivering droplets so that at least two regions in which the droplets are delivered can overlap with each other, by using at least two different liquid ejecting portions among said plurality of liquid ejecting portions, and by deflecting droplets ejected from at least one of said two different liquid ejecting portions, said pixel column or said pixel can be formed, wherein a plurality of said droplets are selectively transmitted toward a desired location and a number of droplets selectively positioned at the desired location is altered to express a gradation in image information.

* * * * *